US008298395B2

(12) United States Patent
Metzger

(10) Patent No.: US 8,298,395 B2
(45) Date of Patent: Oct. 30, 2012

(54) ELECTROPLATING APPARATUS

(75) Inventor: Hubert F. Metzger, Brookfield, WI (US)

(73) Assignee: Chema Technology, Inc., Brookfield, WI (US)

( * ) Notice: Subject to any disclaimer, the term of this patent is extended or adjusted under 35 U.S.C. 154(b) by 534 days.

(21) Appl. No.: 12/497,477

(22) Filed: Jul. 2, 2009

(65) Prior Publication Data

US 2010/0170801 A1 Jul. 8, 2010

Related U.S. Application Data

(63) Continuation-in-part of application No. 10/852,597, filed on May 24, 2004, now Pat. No. 7,556,722, which is a continuation-in-part of application No. 09/992,205, filed on Nov. 6, 2001, now Pat. No. 6,929,723, which is a continuation-in-part of application No. 09/528,393, filed on Mar. 20, 2000, now Pat. No. 6,547,936, which is a continuation-in-part of application No. 09/345,263, filed on Jun. 30, 1999, now Pat. No. 6,231,728, application No. 12/497,477, which is a continuation-in-part of application No. 12/386,170, filed on Apr. 13, 2009, now Pat. No. 7,914,658.

(51) Int. Cl.
*C25D 7/00* (2006.01)
*C25D 5/04* (2006.01)

(52) U.S. Cl. ..... 205/98; 205/143; 205/151; 205/292

(58) Field of Classification Search ..... None
See application file for complete search history.

(56) References Cited

U.S. PATENT DOCUMENTS

| | | | |
|---|---|---|---|
| 2,702,260 | A | 2/1955 | Massa |
| 2,852,450 | A | 9/1958 | Mundell |
| 3,326,316 | A | 6/1967 | McDonald |
| 3,351,539 | A | 11/1967 | Branson |
| 3,647,646 | A | 3/1972 | Tucker et al. |
| 3,923,610 | A | 12/1975 | Bergin et al. |
| 3,933,601 | A | 1/1976 | Ishibashi et al. |

(Continued)

FOREIGN PATENT DOCUMENTS

DE 8 84 404 7/1953

(Continued)

OTHER PUBLICATIONS

Crest Ultrasonics Corporation, "Martin Walter Push-Pull TM Transducers," Technical Specifications, no date, 2 pages.

(Continued)

*Primary Examiner* — Harry D Wilkins, III
(74) *Attorney, Agent, or Firm* — Foley & Lardner LLP

(57) ABSTRACT

An apparatus for electroplating a rotogravure cylinder out of a plating solution is disclosed. The apparatus includes a plating tank adapted to support the cylinder and to contain a plating solution so that the cylinder is at least partially disposed into the plating solution. The apparatus also includes a non-dissolvable anode at least partially disposed within the plating solution. A current source is electrically connected to the non-dissolvable anode and to the cylinder. An ultrasonic system may be provided to introduce wave energy into the plating solution includes at least one transducer element mountable within the tank and a power generator adapted to provide electrical energy to the transducer element. A holding tank having a circulation pump, a mixing system and heating and cooling elements for the plating solution may be provided.

30 Claims, 31 Drawing Sheets

U.S. PATENT DOCUMENTS

| | | | | | |
|---|---|---|---|---|---|
| 3,947,330 | A | * | 3/1976 | Heidenberger | 205/127 |
| 3,960,675 | A | | 6/1976 | Motter | |
| 4,076,597 | A | | 2/1978 | Subramanyan et al. | |
| 4,102,756 | A | | 7/1978 | Castellani et al. | |
| 4,113,361 | A | | 9/1978 | Nakano | |
| 4,269,670 | A | | 5/1981 | Smith | |
| 4,289,670 | A | | 9/1981 | Creekmore et al. | |
| 4,318,794 | A | | 3/1982 | Adler | |
| 4,331,527 | A | | 5/1982 | Metzger | |
| 4,352,727 | A | | 10/1982 | Metzger | |
| 4,425,212 | A | | 1/1984 | Francis | |
| 4,437,948 | A | | 3/1984 | Okinaka et al. | |
| 4,445,980 | A | | 5/1984 | Smith | |
| 4,489,584 | A | | 12/1984 | Gall et al. | |
| 4,503,769 | A | | 3/1985 | Andersen | |
| 4,568,484 | A | | 2/1986 | Takayasu | |
| H0036 | H | | 3/1986 | Smith | |
| 4,585,540 | A | | 4/1986 | Beer et al. | |
| 4,647,345 | A | | 3/1987 | Polan | |
| 4,659,446 | A | * | 4/1987 | Shafer et al. | 204/212 |
| 4,812,219 | A | | 3/1989 | Sattrup et al. | |
| 4,830,758 | A | | 5/1989 | Bodine | |
| 4,908,242 | A | | 3/1990 | Hughes et al. | |
| 5,089,109 | A | | 2/1992 | Suganuma et al. | |
| 5,128,000 | A | | 7/1992 | Klotz et al. | |
| 5,232,576 | A | | 8/1993 | Matsumoto et al. | |
| 5,318,683 | A | | 6/1994 | Smith et al. | |
| 5,326,455 | A | | 7/1994 | Kubo et al. | |
| 5,344,538 | A | | 9/1994 | Chamberlain et al. | |
| 5,409,594 | A | | 4/1995 | Al-Jiboory et al. | |
| 5,417,841 | A | | 5/1995 | Frisby | |
| 5,695,621 | A | | 12/1997 | Pop et al. | |
| 5,707,428 | A | | 1/1998 | Feldman et al. | |
| 5,707,438 | A | | 1/1998 | Carlton | |
| 5,783,058 | A | | 7/1998 | Fowler et al. | |
| 5,795,460 | A | | 8/1998 | Al-Jiboory et al. | |
| 5,925,231 | A | | 7/1999 | Metzger | |
| 5,997,712 | A | | 12/1999 | Ting et al. | |
| 6,197,169 | B1 | | 3/2001 | Metzger | |
| 6,217,729 | B1 | | 4/2001 | Zolotarsky et al. | |
| 6,231,728 | B1 | | 5/2001 | Metzger | |
| 6,547,936 | B1 | | 4/2003 | Metzger | |
| 6,929,723 | B2 | * | 8/2005 | Metzger | 204/222 |
| 7,556,722 | B2 | | 7/2009 | Metzger | |
| 2003/0006133 | A1 | * | 1/2003 | Metzger | 204/232 |
| 2003/0091619 | A1 | | 5/2003 | Spencer | |
| 2005/0000814 | A1 | * | 1/2005 | Metzger | 205/69 |
| 2009/0255819 | A1 | | 10/2009 | Metzger | |

FOREIGN PATENT DOCUMENTS

| | | | |
|---|---|---|---|
| DE | 17 39 307 | | 2/1957 |
| DE | 14 21 951 | | 4/1969 |
| DE | 14 96 892 | | 4/1969 |
| DE | 19 08 442 | | 9/1969 |
| DE | 20 51 778 | | 5/1971 |
| DE | 72 30 374 | | 8/1972 |
| DE | 24 15 705 | A1 | 10/1975 |
| DE | 24 49 735 | A1 | 4/1976 |
| DE | 77 29 076 | | 1/1978 |
| DE | 27 22 857 | A1 | 11/1978 |
| DE | 29 36 247 | A1 | 3/1981 |
| DE | 30 42 490 | A1 | 6/1982 |
| DE | 31 50 469 | A1 | 6/1983 |
| DE | 32 29 545 | A1 | 10/1983 |
| DE | 83 20 212 | U1 | 12/1983 |
| DE | 33 00 883 | A1 | 7/1984 |
| DE | 34 21 017 | A1 | 12/1984 |
| DE | 33 25 316 | A1 | 1/1985 |
| DE | 34 29 890 | A1 | 2/1986 |
| DE | 40 08 254 | A1 | 9/1991 |
| DE | 41 13 361 | A1 | 10/1991 |
| DE | 42 11 881 | A1 | 10/1993 |
| DE | 42 24 252 | C1 | 12/1993 |
| DE | 42 36 419 | C1 | 1/1994 |
| DE | 42 35 227 | A1 | 4/1994 |
| DE | 44 30 430 | C1 | 12/1995 |
| EP | 0 248 118 | A1 | 12/1986 |
| EP | 0 384 194 | B1 | 8/1990 |
| EP | 0 567 042 | A1 | 4/1993 |
| EP | 0 884 404 | A2 | 8/1997 |
| EP | 0 829 558 | A1 | 3/1998 |
| EP | 0 882 817 | B1 | 4/1998 |
| EP | 0 989 209 | A2 | 9/1999 |
| EP | 1 138 806 | A2 | 3/2001 |

OTHER PUBLICATIONS

Dixon Ticonderoga Company, "Grapho Kote No. 4 Ladle Coating," Product Data Sheet Pds-G332, no date, 2 pages.

Eltech, Anode Technologies Group, "DSA Insoluble Anodes for Wire Plating," Copyright 2001, no date, 2 pages.

Ex Parte Quayle for U.S. Appl. No. 09/151,317, mail date May 23, 2000, 4 pages.

J.R. Cox, "The Impact of Electromechanical Engraving Specifications on Streaking and Hazing," Gravure, Winter 1994, pp. 12-15.

R. Martin AG Brochure entitled "Plating installations type B," no date, selected pages (4 pages total).

Maurice O'Donoghue, The Ultrasonic Cleaning Process, printed from Internet on Nov. 14, 1996, dated Mar. 6, 1996, 7 pages.

Notice of Allowance for U.S. Appl. No. 08/939,803, mail date Dec. 15, 1998, 3 pages.

Notice of Allowance for U.S. Appl. No. 09/151,317, mail date Aug. 8, 2000, 4 pages.

Notice of Allowance for U.S. Appl. No. 09/345,263, mail date Jan. 3, 2001, 2 pages.

Notice of Allowance for U.S. Appl. No. 09/528,393, mail date Apr. 18, 2002, 4 pages.

Notice of Allowance for U.S. Appl. No. 09/992,205, mail date Feb. 13, 2004, 7 pages.

Notice of Allowance for U.S. Appl. No. 09/992,205, mail date May 11, 2005, 4 pages.

Notice of Allowance for U.S. Appl. No. 10/852,597, mail date Jan. 6, 2009, 10 pages.

Office Action for European Application No. 01106310.4, mail date Apr. 22, 2009, 3 pages.

Office Action for European Application No. 01106310.4, mail date Feb. 1, 2007, 4 pages.

Office Action for European Application No. 01106310.4, mail date Jan. 16, 2008, 4 pages.

Office Action for European Application No. 01106310.4, mail date Jan. 25, 2006, 4 pages.

Office Action for European Application No. 97250241.3, mail date Aug. 6, 2002, 3 pages.

Office Action for European Application No. 98250146.2, mail date Sep. 9, 2002, 3 pages.

Office Action for European Application No. 99710010.2, mail date Mar. 2, 2010, 2 pages.

Office Action for U.S. Appl. No. 08/755,488, mail date Jul. 30, 1997, 6 pages.

Office Action for U.S. Appl. No. 08/939,803, mail date May 5, 1998, 8 pages.

Office Action for U.S. Appl. No. 09/151,317, mail date Dec. 1, 1999, 9 pages.

Office Action for U.S. Appl. No. 09/345,263, mail date Aug. 31, 2000, 9 pages.

Office Action for U.S. Appl. No. 09/528,393, mail date Apr. 23, 2001, 7 pages.

Office Action for U.S. Appl. No. 09/528,393, mail date Oct. 24, 2001, 5 pages.

Office Action for U.S. Appl. No. 09/992,205, mail date Jun. 17, 2003, 9 pages.

Office Action for U.S. Appl. No. 09/992,205, mail date Mar. 11, 2005, 13 pages.

Office Action for U.S. Appl. No. 10/852,597, mail date Jul. 16, 2007, 13 pages.

Office Action for U.S. Appl. No. 10/852,597, mail date Mar. 26, 2008, 9 pages.

Office Action for U.S. Appl. No. 10/852,597, mail date Sep. 9, 2008, 20 pages.

Office Action for U.S. Appl. No. 12/386,170, mail date Apr. 29, 2010, 11 pages.

Partial Search Report for European Application No. 01106310.4, mail date May 7, 2004, 5 pages.
Search Report for European Application No. 01106310.4, mail date Sep. 24, 2004, 7 pages.
Search Report for European Application No. 98250146.2, mail date Sep. 23, 1999, 3 pages.
U.S. Appl. No. 12/386,170, filed Apr. 13, 2009, Metzger.
Electroplating Engineering Handbook (Van Nostrand Reinhold Company, A. Kenneth Graham, ed. 1971, 4 pages total).
Flexo+Tief-Druck, Jan. 2008, p. 38 and Translation to English.
Flexo+Tief-Druck, Jul. 2008, p. 49.
H.E. Ricks, "Ultrasonics Improves, Shortens, and Simplifies Plating Operations," MPM, pp. 47-49 (Mar. 1962) Best Available Copy.
Metzger, Hubert et al., "DisCoP Technology, Potentially Reducing Copper-Plating Time by 40 Percent!," Gravure, Apr. 2002, 4 pages.
Metzger, Hubert et al., Flexo & Gravure Intl, Jun. 2008, pp. 102-103.
Metzger, Hubert, "DisCoP—The future of copper plating," Gravure News, Jan. 2007, pp. 32-33.
Metzger, Hubert, "DisCoP: The Future of Copper Plating," Gravure, Feb. 2006, pp. 48-49.
Metzger, Hubert, Flexo+Tief-Druck, Mar. 2008, pp. 58-59.
Power Plating Chrome Plant , PMC Corp. , 6 pages.
Ultrasonics General Information (printed from Internet on Nov. 14, 1996; dated Mar. 18, 1995, 3 pages total).
W.D. Mogerman, "Ultrasonics in the Plating Industry," Plating, pp. 941-947 (Aug. 1967) Best Available Copy.
Wessendorf, Ansgar, "A new process and many advancements," Flexo & Gravure Intl., Mar. 2008, pp. 58-59.

* cited by examiner

FIG. 1
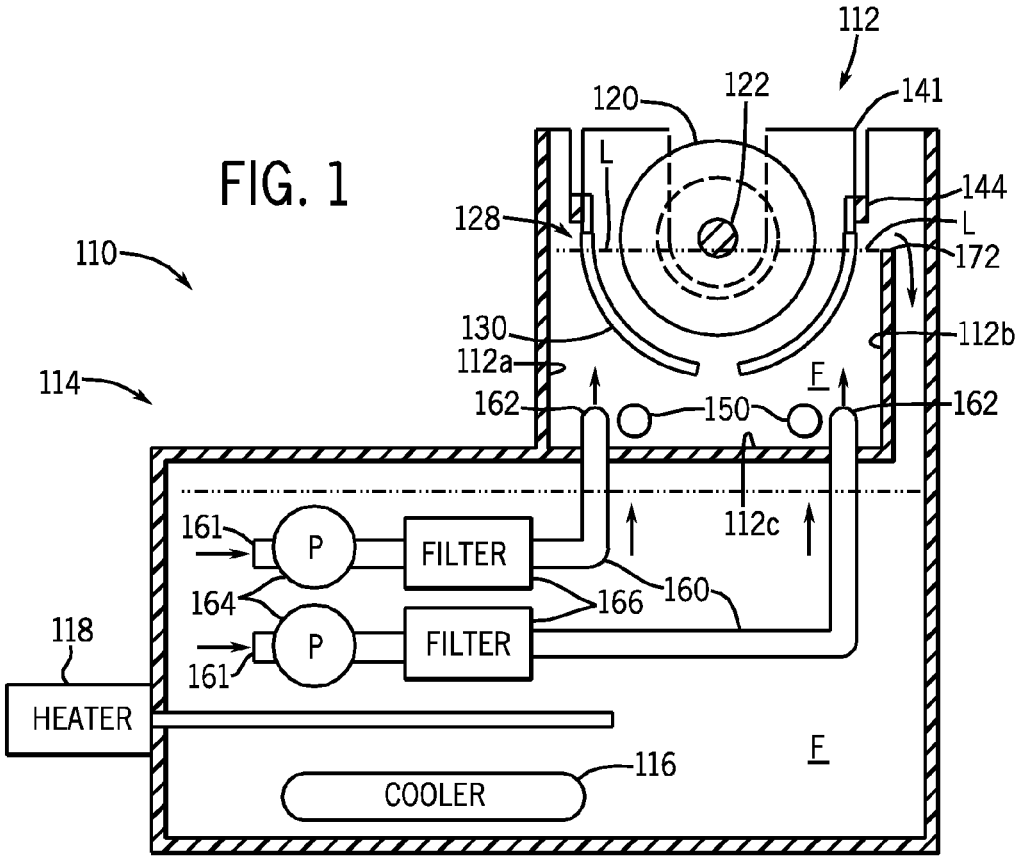
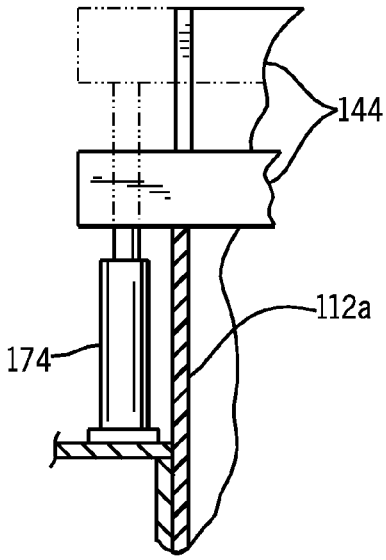
FIG. 5

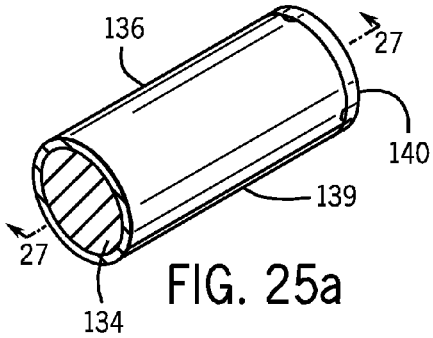
FIG. 25a
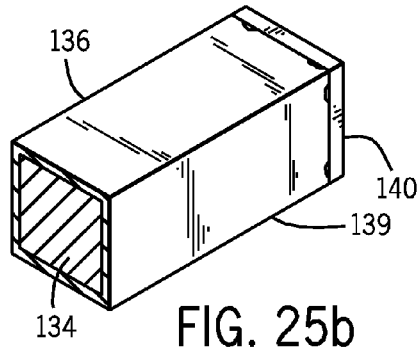
FIG. 25b
FIG. 25c
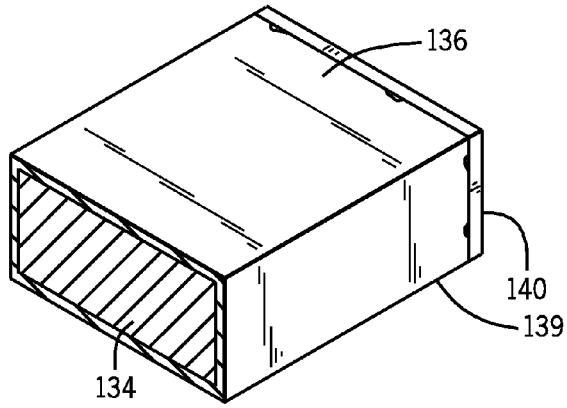
FIG. 26a
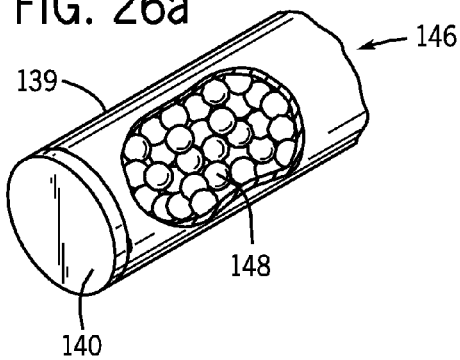
FIG. 26b
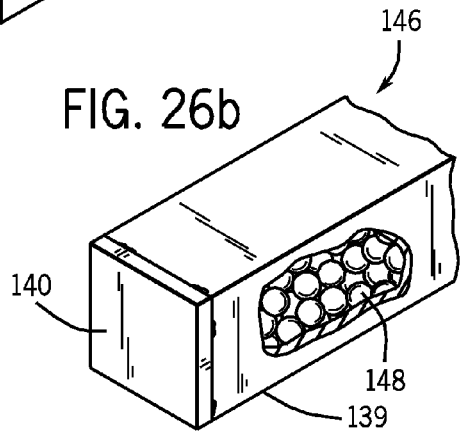
FIG. 27
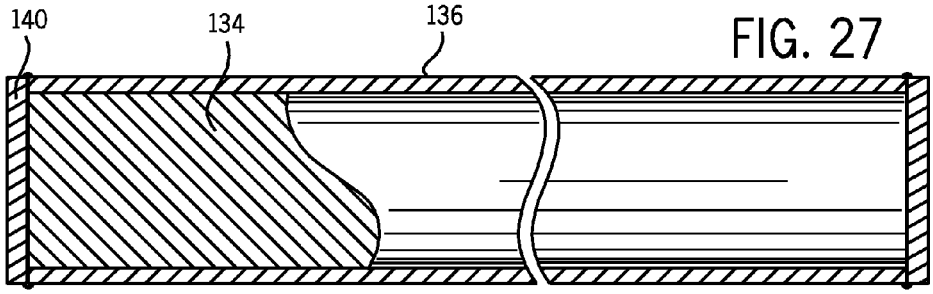

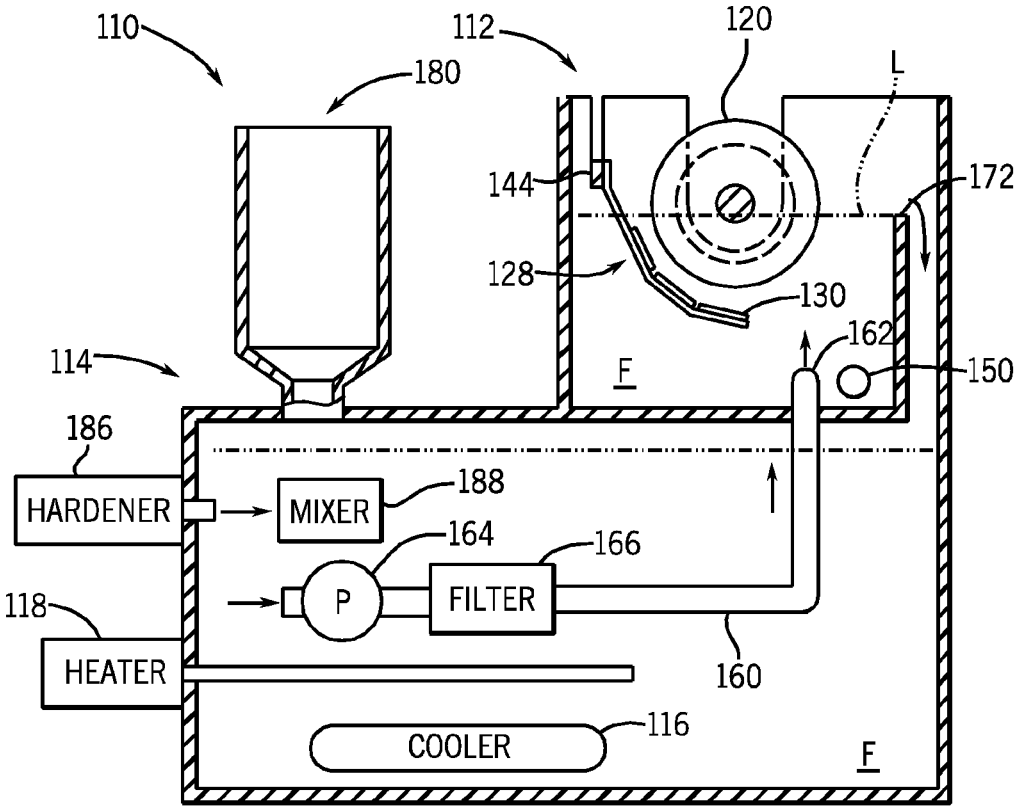
FIG. 39
FIG. 40
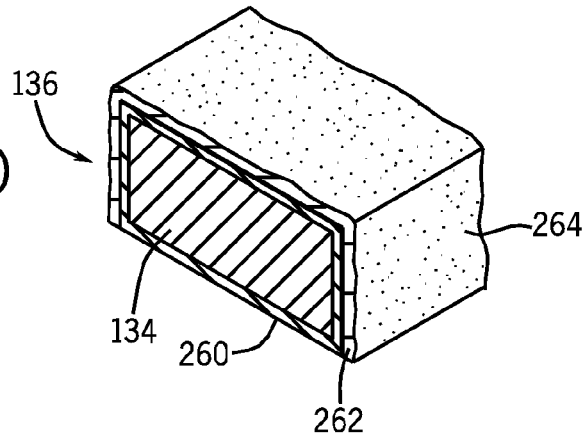

ELECTROPLATING APPARATUS

RELATED APPLICATIONS

This application is a continuation-in-part of application Ser. No. 12/386,170 filed Apr. 13, 2009 and is a continuation-in-part of application Ser. No. 10/852,597 filed May 24, 2004, which is a continuation-in-part of application Ser. No. 09/992,205 filed Nov. 6, 2001, incorporated by reference herein which is a continuation-in-part of application Ser. No. 09/528,393, titled "Electroplating Apparatus Having a Non-Dissolvable Anode," filed Mar. 20, 2000, incorporated by reference herein, which is in turn a continuation in-part of application Ser. No. 09/345,263, titled "Electroplating Apparatus," filed Jun. 30, 1999, issued as U.S. Pat. No. 6,231,728 on May 15, 2001, incorporated by reference herein.

FIELD

The present invention relates to an electroplating apparatus using a non-dissolvable anode.

BACKGROUND

In a conventional electroplating apparatus, it is customary to bathe an object to be plated (electrically charged as a cathode) in a tank filled with a plating solution (i.e., electrolyte fluid) and metallic bars or metallic nuggets (electrically charged as an anode), supported in a set of baskets made of titanium or of a plastic material and disposed around each side of the object (e.g., a rotogravure printing cylinder).

In an arrangement for plating a rotogravure cylinder, shown in U.S. Pat. No. 4,352,727 issued to Metzger, and incorporated by reference herein, the metallic bars or metallic nuggets are disposed below the surface of the plating solution. Ions move from the metallic bars or metallic nuggets through the plating solution to the surface of the cylinder (preferably rotating) during the plating process (or in the reverse direction in the deplating process). Where plating is done directly from a plating solution, ions move directly from the solution to the surface of the rotating cylinder.

Over time, refinements of this system have facilitated satisfactory control of the plating process to achieve the desirable or necessary degree of consistent plating and uniformity in the plated surface of an object, particularly in the case of a rotogravure cylinder. However, the complete process is comparatively slow, and extra polishing steps are typically necessary after plating in order to produce a desirable uniform surface (e.g., consistent grain structure) on the object. According to the known arrangement, the overall efficiency of the process necessary to produce a suitably uniform plated surface on an object can be adjusted either by reducing the current density, which increases the plating time but reduces the number or duration of additional polishing steps, or by increasing the current density, which reduces the plating time but increases the number or duration of additional polishing steps.

One of the causes of an undesirable plated surface is that in the known arrangement, during operation a metal sludge, formed from metal displaced from the metallic bars, nuggets or anode, tends to accumulate on and about the object during the plating process, forming uneven and undesirable deposits (typically in areas of low current density). These uneven depositions caused by the sludge necessitates an increased number or longer duration of additional polishing steps. The sludge may also build up between the contact surfaces of the baskets or anodes which may affect the efficiency of the plating process. Other surfaces of the electroplating apparatus may also become fouled with sludge and other matter.

Another method of reducing the effects of the sludge is to expose the object and at least portions of the electroplating apparatus to ultrasonic energy throughout at least a portion of the plating process as described in U.S. Pat. No. 5,925,231 issued to Metzger, incorporated by reference herein. Ultrasonic wave energy has been used successfully in surface cleaning applications. The long-known advantages in using ultrasonic energy in electroplating have also been described in such articles as "Ultrasonics in the Plating Industry," *Plating*, pp. 141-47 (August 1967), and "Ultrasonics Improves, Shortens and Simplifies Plating Operations," *MPM*, pp. 47-49 (March 1962), both of which are incorporated by reference herein. It has been learned that ultrasonic energy may advantageously be employed to improve the quality (e.g., uniformity and consistency of grain structure) of a plating process by providing for uniformity and efficiency of ion movement. In other applications, it has been found that copper can be plated onto a surface in a production system using ultrasonic energy at up to four times the rate ordinarily possible. It has also been found that the use of ultrasonic energy in an electroplating process provides an increase in both the anode and cathode current efficiency, and moreover, the practical benefit of faster plating with less hydrogen embrittlement (e.g., with less oxidation of the hydrogen on the plating and deplating surfaces).

Accordingly, it would be advantageous to have an electroplating apparatus configured to capitalize on the advantages of substantially removing or eliminating material that is vulnerable to chemical attack or dissolution in the plating solution (or adequately protecting any material that cannot be removed), to prevent the buildup of sludge during the plating process, thereby reducing the number or duration of additional polishing steps. It would also be advantageous to have an electroplating apparatus employing an anode that is not vulnerable to chemical attack or dissolution by the plating solution (e.g., a non-dissolvable anode), for example, by substantially employing non-dissolvable materials (or adequately protecting any material that is not non-dissolvable), and thereby reducing or eliminating material that acts as the source of the sludge, so that the build-up of sludge during the plating process will be substantially reduced or eliminated and a more uniform and consistent grain structure on the plated surface of the object will be obtained. It would further be advantageous to have an apparatus configured to combine the advantages of implementing a non-dissolvable anode with the advantages of ultrasonic energy in plating an object (e.g., a rotogravure cylinder) in order to substantially reduce or eliminate the build-up of metal sludge during the plating process and obtain a more uniform and consistent grain structure on the plated surface of the object through a more efficient process.

It would be desirable to provide a method and apparatus providing some or all of these and other advantageous features.

SUMMARY

One embodiment relates to an apparatus for electroplating a rotogravure cylinder out of a plating solution. The apparatus includes a plating tank adapted to support the object and to contain the plating solution so that the object is at least partially disposed into the plating solution, and an anode system which includes at least one anode at least partially disposed within the plating solution. The cylinder and anode system both connectable to a current source. The apparatus further includes an ultrasonic system that introduces wave energy into the plating solution. The ultrasonic system includes at least one transducer element mountable within the plating tank to the mounting structure and a power generator adapted to provide electrical energy to the at least one transducer element.

Another embodiment relates to an apparatus for electroplating a rotogravure cylinder out of a plating solution. The apparatus includes a plating tank adapted to rotatably maintain the cylinder and to contain the plating solution so that the cylinder is at least partially disposed into the plating solution, and an anode system having at least one anode at least partially disposed within the plating solution. The anode includes a conductive core, a first layer including titanium securely applied to the conductive core and a second layer including at least one platinum-group metal or platinum-group metal oxide and at least one valve metal or valve metal oxide The cylinder and anode system both connectable to a current source.

An additional embodiment relates to an apparatus for electroplating a rotogravure cylinder out of a plating solution. The apparatus includes a plating tank adapted to rotatably maintain the cylinder and to contain the plating solution so that the cylinder is at least partially disposed into the plating solution, and an anode system having at least one anode at least partially disposed within the plating solution. The anode includes a titanium core and a protective surface material that includes a mixture of iridium or iridium oxide and a valve metal or valve metal oxide. They cylinder and anode system both connectable to a current source. The apparatus further includes an ultrasonic system that introduces wave energy into the plating solution. The ultrasonic system includes at least one transducer element mountable within the plating tank to the mounting structure and a power generator adapted to provide electrical energy to the at least one transducer element.

BRIEF DESCRIPTION OF THE DRAWINGS

FIG. 1 is a schematic sectional elevation view of an electroplating apparatus for plating a rotogravure cylinder according to an embodiment utilizing a non-dissolvable anode.

FIG. 5 is a schematic sectional elevation view of a lifter for the apparatus of FIG. 1.

FIG. 25*a* is a fragmentary perspective view of a conductor having a generally circular cross-section.

FIG. 25*b* is a fragmentary perspective view of a conductor having a square cross-section.

FIG. 25*c* is a fragmentary perspective view of a conductor having a generally rectangular cross-section.

FIG. 26*a* is a fragmentary perspective view of an alternate embodiment of a generally circular conductor including a plurality of conductive pieces.

FIG. 26*b* is a fragmentary perspective view of an alternate embodiment of a generally rectangular conductor including a plurality of conductive pieces.

FIG. 27 is a sectional view of the conductor of FIG. 25*a* taken through line 27.

FIG. 39 is a schematic sectional elevation view of an electroplating apparatus for plating a rotogravure cylinder according to an alternate embodiment employing a non-dissolvable anode.

FIG. 40 is a fragmentary perspective view of a conductor having a layered surface material.

DETAILED DESCRIPTION OF THE PREFERRED EMBODIMENTS

Figure 2:
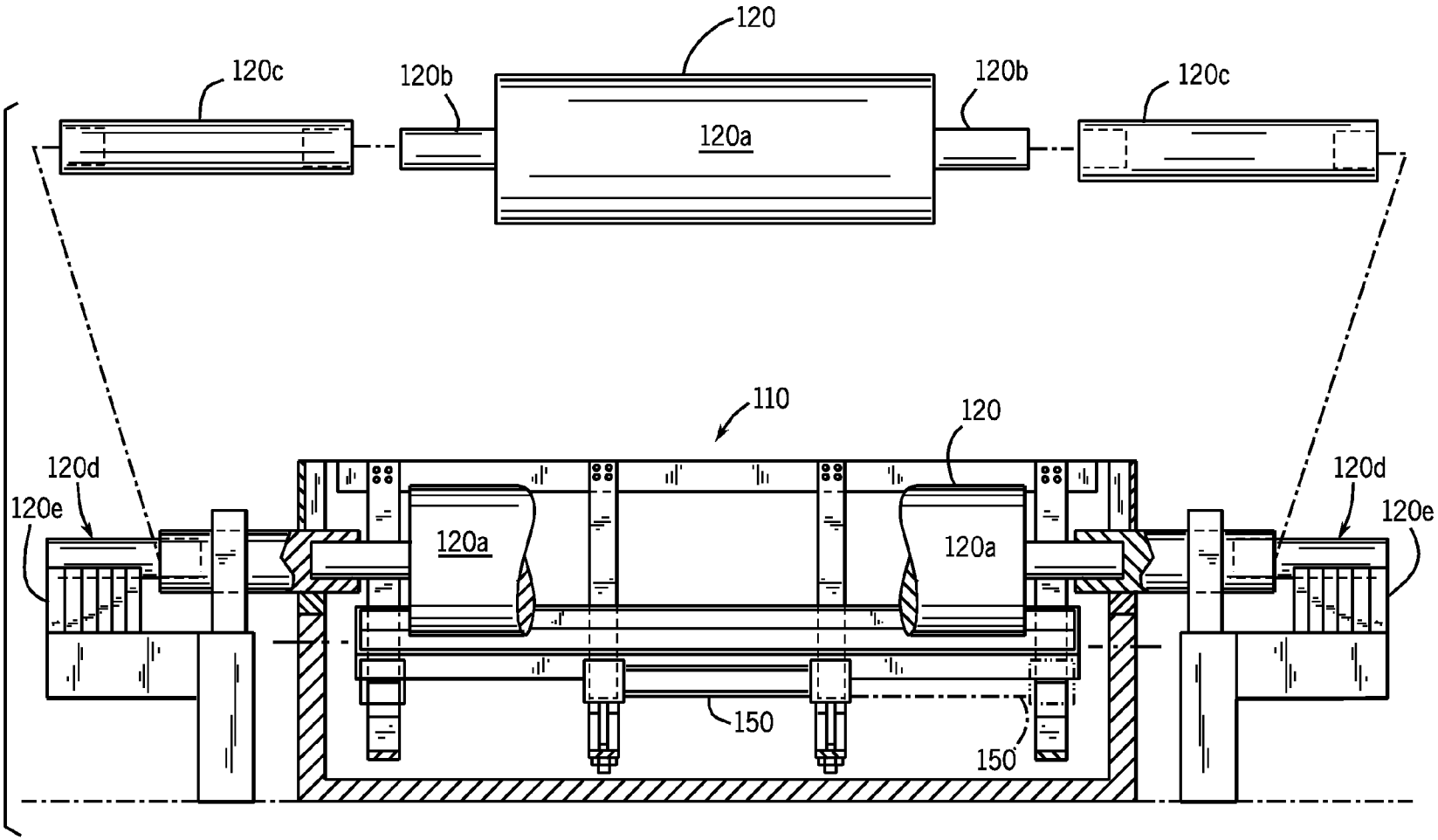
FIG. 2 is a sectional side and elevation view of the plating tank (with a rotogravure cylinder).

Referring to FIG. 1, an exemplary embodiment of an apparatus for electroplating an object (shown as a rotogravure cylinder) is shown. Apparatus 110 includes plating tank 112 containing a plating solution (electrolytic fluid such as copper sulfate or the like in an appropriate solution) indicated by reference letter F. Apparatus 110 is configured to support object 120 such that object 120 is at least partially submerged in the plating solution. Apparatus 110 further includes an anode system 128 (cathode system for deplating) that includes at least one non-dissolvable anode 130. For plating object 120, anode system 128 is connected to an anode side of a plating power supply (e.g., a current source of known design) and object 120 is connected to a cathode side of the power supply. For deplating, the anode-cathode connections are reversed. According to any exemplary embodiment, apparatus 110 may include at least one transducer element 150, and a holding tank 114 as shown schematically in FIGS. 1, 9 and 22.

According to any exemplary embodiment, the plating apparatus is configured to plate (or deplate) an object (shown as rotogravure cylinder 120 in the FIGURES). According to FIG. 2, rotogravure cylinder 120 is rotatably supported at its ends (e.g., upon an extending central shaft) and is at least partially submerged into the plating solution. In plating a rotogravure cylinder, the cylinder may be rotated such that the top of the rotating cylinder is disposed slightly above the surface level of the plating solution so that a washing action occurs as the surface of the cylinder breaks across the surface of the plating solution. Accordingly, cylinder 120 is submerged to a level of approximately one-half to one-third of the cylinder diameter. In some embodiments, plating apparatus 110 is configured such that cylinder 120 is at least about 65 to 70% submerged. According to alternate embodiments, the cylinder may be fully submerged.

As shown in FIG. 1, cylinder 120 is rotatably supported at its ends by bearings within a journal 122, in which it is rotatably driven by a suitable powering device (not shown). According to one embodiment, a rate of rotation for cylinder 120 can have a value of 120 to 220 revolutions per minute (rpm). In other embodiments, the rate of rotation can have a value of 150 to 200 rpm. The direction of the cylinder rotation may depend on the exact design of the plating apparatus. For example, as shown in FIG. 39, the cylinder suitably rotates in a clockwise direction.

Cylinder 120, shown in FIGS. 1, 5, and 39 may be one of a standard size (e.g., having a circumference of about 400 mm to about 1800 mm), or, according to alternative embodiments, cylinders of other diameters may be accommodated. Cylinder 120 may be one of a common or standard length for a particular application (e.g., having a length of approximately 40 cm to 4 m), or, according to alternative embodiments, cylinders of other lengths may be accommodated. According to any exemplary embodiment, the cylinder mounting and drive system is of a conventional arrangement known to those of ordinary skill in the art of rotogravure cylinder plating.

As shown in FIG. 2, cylinder 120 has a cylindrical face surface 120*a* and opposing axial ends 120*b* (having a generally cylindrical shape). Ends 120*b* of cylinder 120 are installed into the apparatus according to a conventional arrangement to allow for axial rotation of the cylinder during the plating process. As shown schematically, each end 120*b* of cylinder 120 is mechanically coupled (e.g., using a chuck or like holding device) to an adapter 120*c* (also allowing for size differences in cylinders) which is retained within a bearing 120*d* for rotational movement about the axis of cylinder (e.g., imparted by a motor, not shown). Brushes 120*e* provide an electrical connection (i.e., as cathode) to cylinder 120.

In some embodiments, each end 120*b* of cylinder 120 may fitted with a shield (not shown) to reduce build-up and roughness on the ends. Such a shield may comprise such materials as stainless steel or titanium. The shields may be electrically isolated or they may be connected to the current source.

Figure 3:
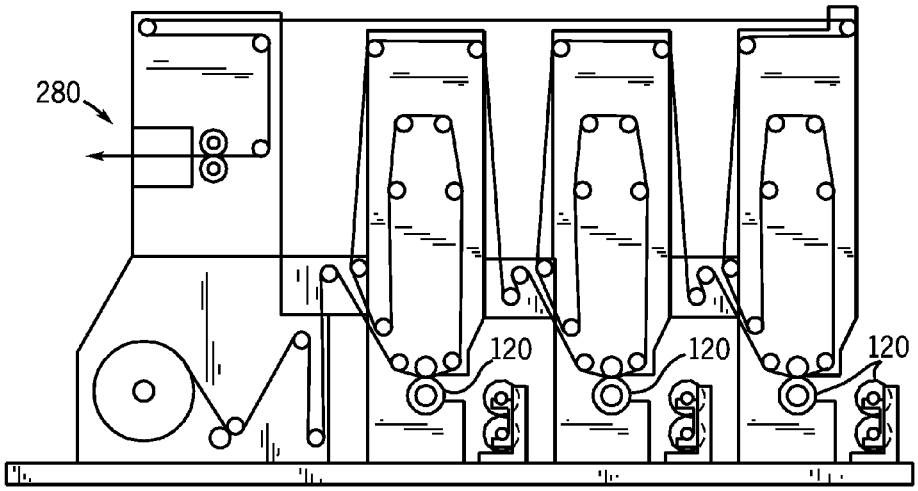
FIG. 3 is a schematic elevation view of a conventional printing system.
Figure 4:
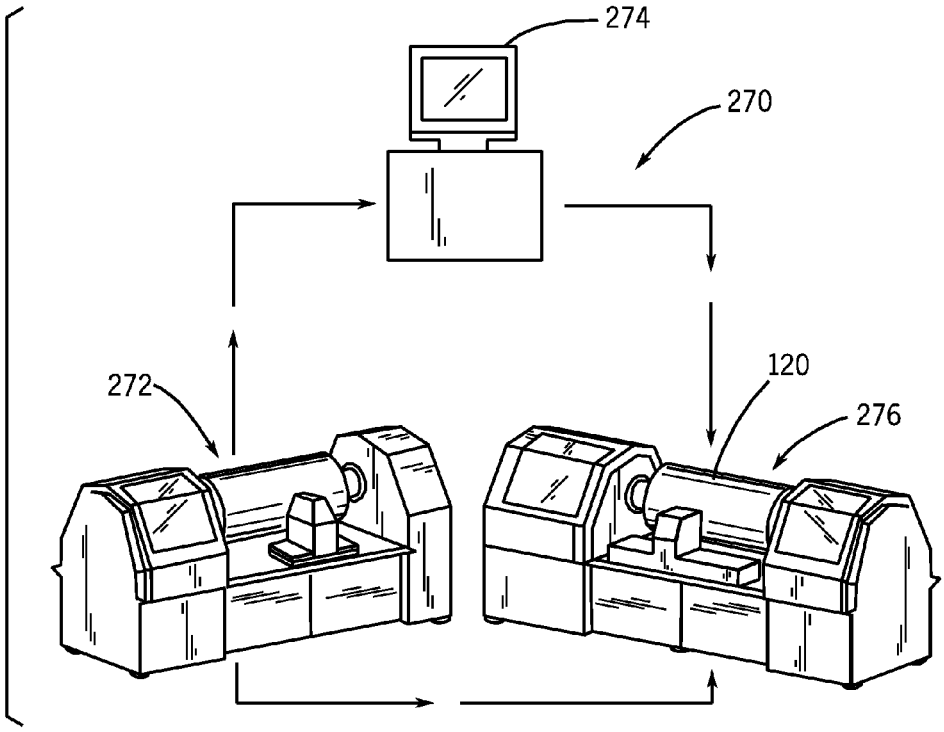
FIG. 4 is a schematic perspective view of a system for engraving an image on a rotogravure cylinder.

According to other exemplary embodiments, cylinder 120 includes a steel (e.g. 99 percent steel) base surface, as is conventional. Exemplary cylinders are commonly available (from commercial suppliers) in a variety of sizes, which can be plated according to the methods taught herein. Such cylinders after plating and engraving are used for printing packaging or publications (e.g., magazines); exemplary cylinder surface diameters and lengths (i.e., surface area to be plated, engraved and printed out) will suit particular applications. Following the plating of the cylinder, the surface can be polished, then engraved with an image, for example using engraving system 270 as shown schematically in FIG. 4, including a scanner 272, computer-based controller 274 and an engraver 276. Such systems are commercially available, for example, from Ohio Electronic Engravers, Inc. of Dayton, Ohio, U.S.A. (Model No. M820). The cylinder can be cleaned (and chrome-plated) and then printed out (according to processes known to those in the art who may review this disclosure), for example, onto a roll or web of paper using a printing system 280 (including cylinders 220) as shown schematically in FIG. 3. When use of the cylinder in the printing operation is completed, the image is removed from the surface of the cylinder (e.g., stripped off if engraved on a Ballard shell or cut off if engraved on a base copper layer). The cylinder can be cleaned and deoxidized, then replated (e.g., with base copper) and engraved for reuse. (Other materials may be similarly plated or engraved and printed on the cylinder by alternative embodiments, such as chrome or zinc.)

According to any exemplary embodiment, apparatus 110 includes an anode system 128 that can accommodate or adjust to accommodate cylinders having different diameters. In one such embodiment, shown in FIG. 5, anode system 128 is coupled to an adjustable rail 144 (shown disposed upon at least one lifter 174 (hydraulic cylinder)) that is raised or lowered depending on the size of cylinder 120 to be plated or deplated. When a cylinder of a lesser diameter is used, anode system 128 is raised so that anode system 128 is brought to an optimal distance (i.e., 5 mm to 80 mm, preferably 10 mm to 60 mm, or, according to an exemplary embodiment, 10 mm to 30 mm) from cylinder 120 as may be determined for a particular application.

Figure 6:
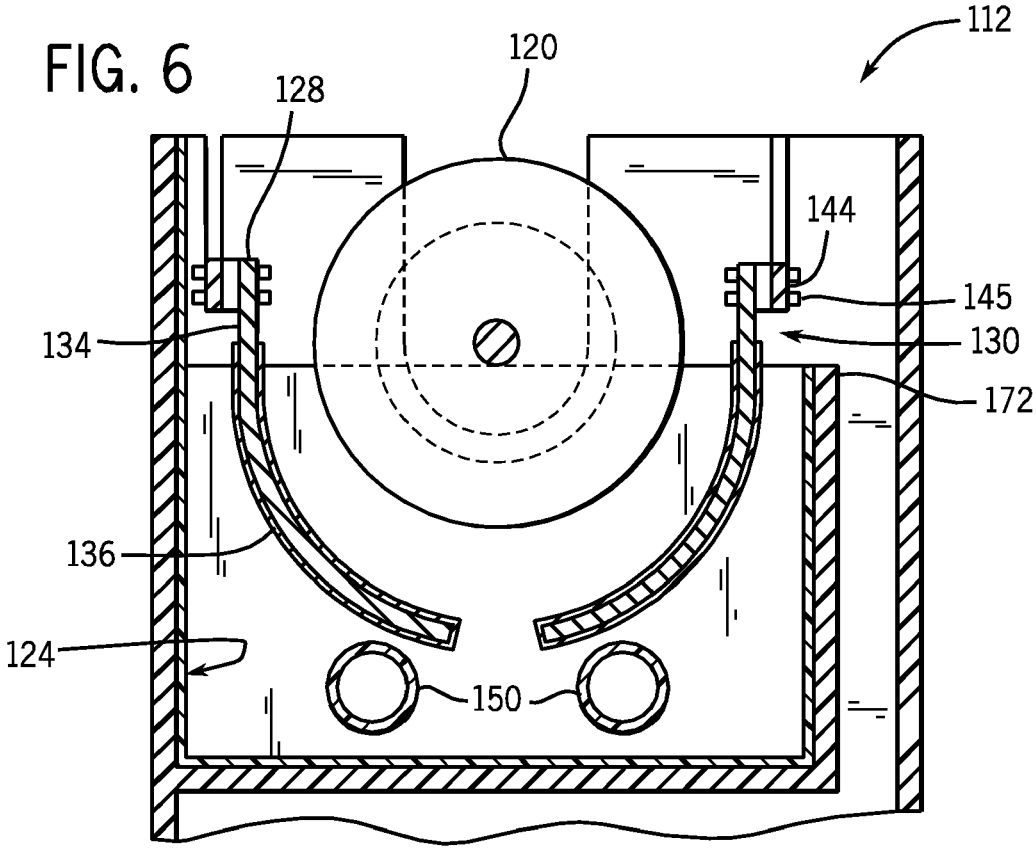
FIG. 6 is a schematic sectional end elevation view of an apparatus for plating a rotogravure cylinder according to an embodiment employing a non-dissolvable anode.
Figure 7:
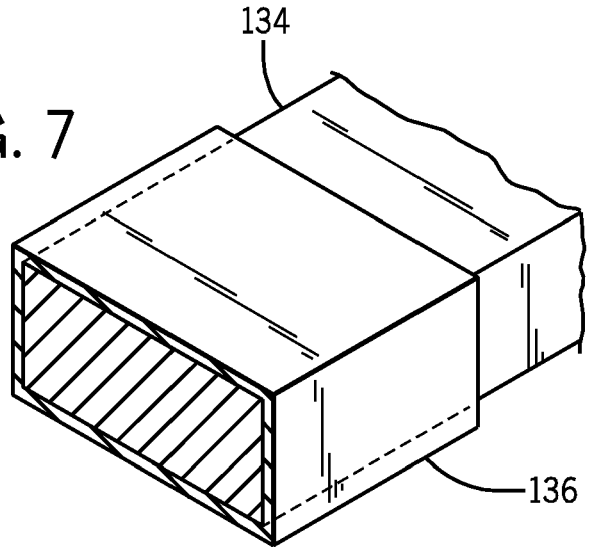
FIG. 7 is a fragmentary perspective view of a conductor having a generally rectangular cross-section.
Figure 9:
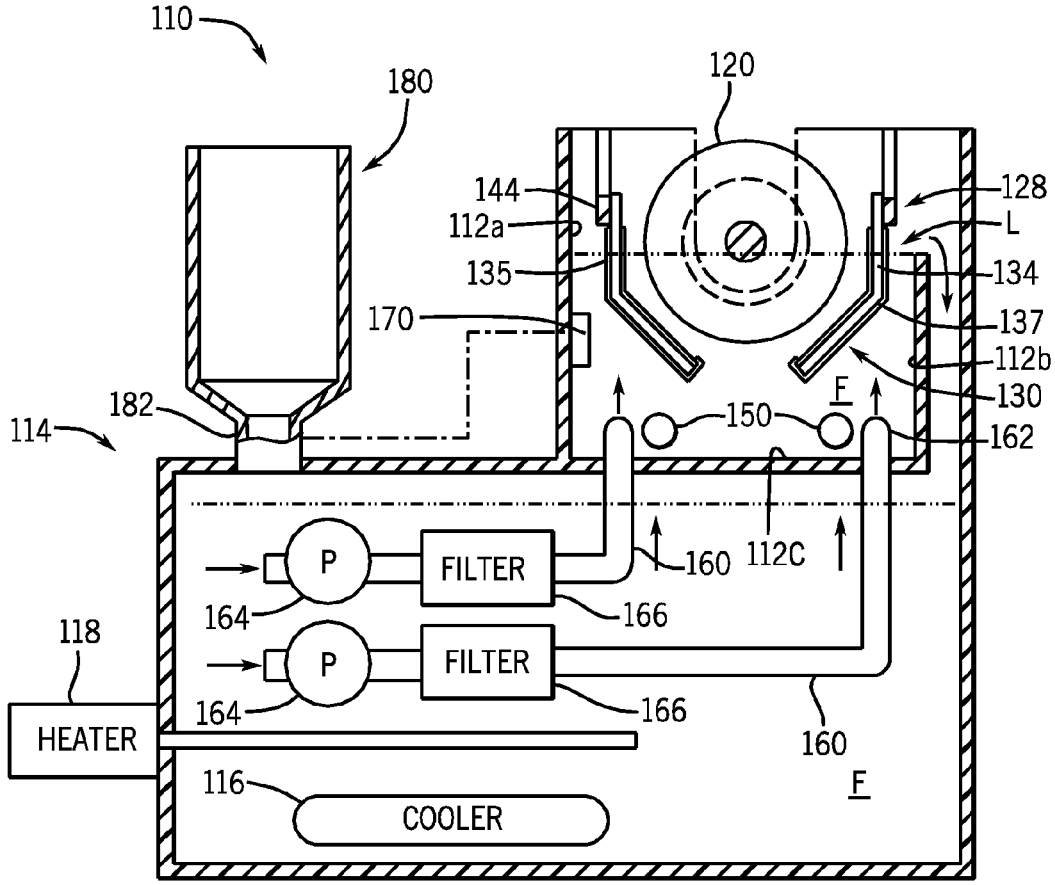
FIG. 9 is a schematic sectional elevation view of an electroplating apparatus for plating a rotogravure cylinder according to an embodiment utilizing a dosing tank and an alternate embodiment of a non-dissolvable anode.
Figure 22:
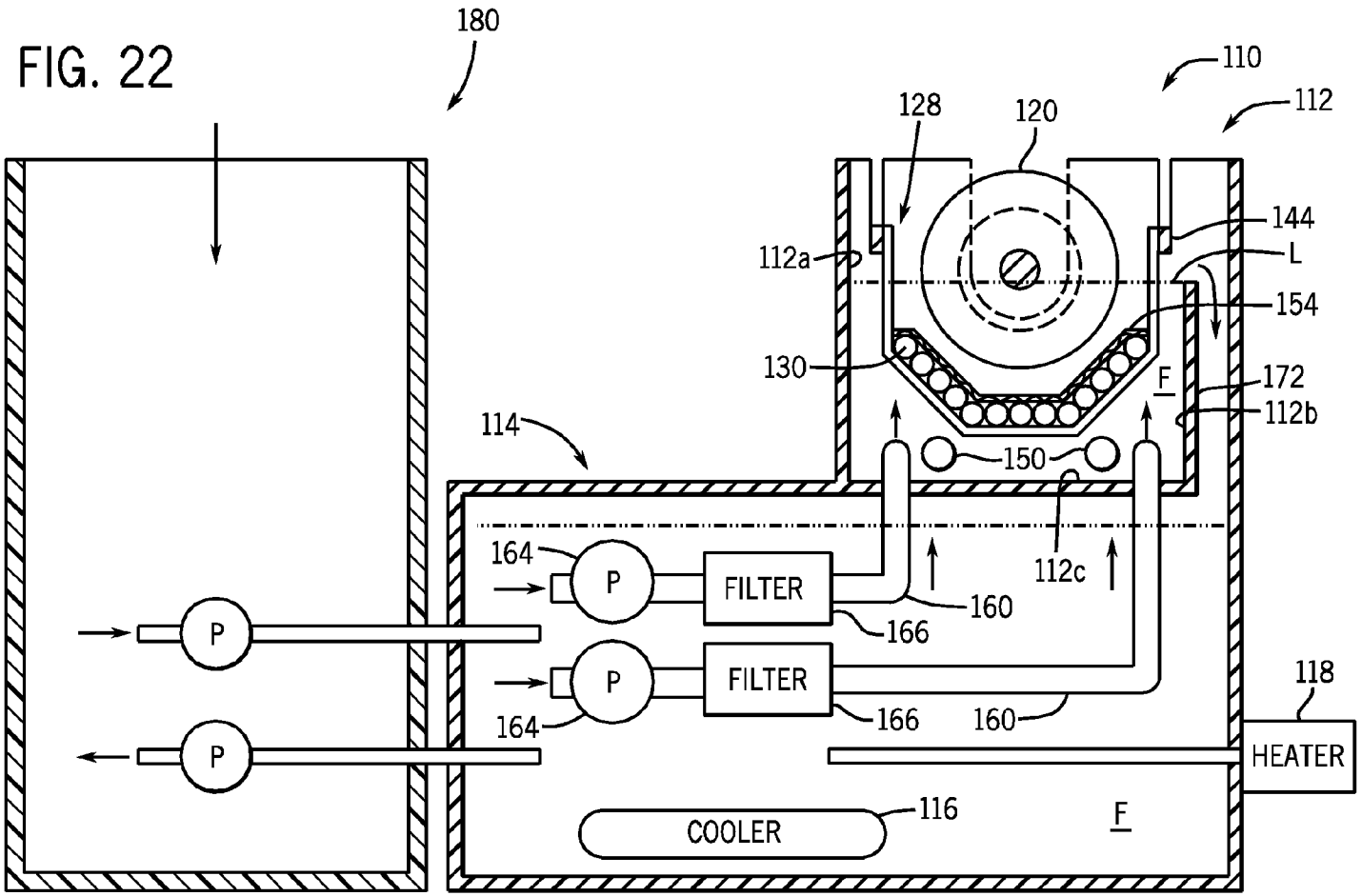
FIG. 22 is a schematic sectional view of an electroplating apparatus for plating a rotogravure cylinder according to an embodiment utilizing a non-dissolvable anode.

According to an exemplary embodiment of a type shown schematically in FIGS. 1, 9 and 22, apparatus 110 includes a plating tank 112 having side walls 112*a* and 112*b*, and bottom 112*c* containing the plating solution (electrolytic fluid F) at a level (indicated by reference letter L) regulated by the height of a weir 172 (e.g., the top of side wall 112*b*), although a variety of methods for controlling the fluid level may be used (i.e., a pump, drain, sensor etc.). Plating tank 112 can take a variety of different shapes and sizes and may be manufactured from any one or a combination of suitable materials. In an exemplary embodiment, plating tank 112 is formed of a material that is substantially resilient to the plating solution (e.g., titanium, plastic, rubber, graphite, glass, silver, etc.), or, as shown in FIG. 6, includes a protective surface material 124 (e.g., lining, coating, sealing, covering, surface treatment, etc.) that is substantially resilient to the plating solution.

Figure 21:
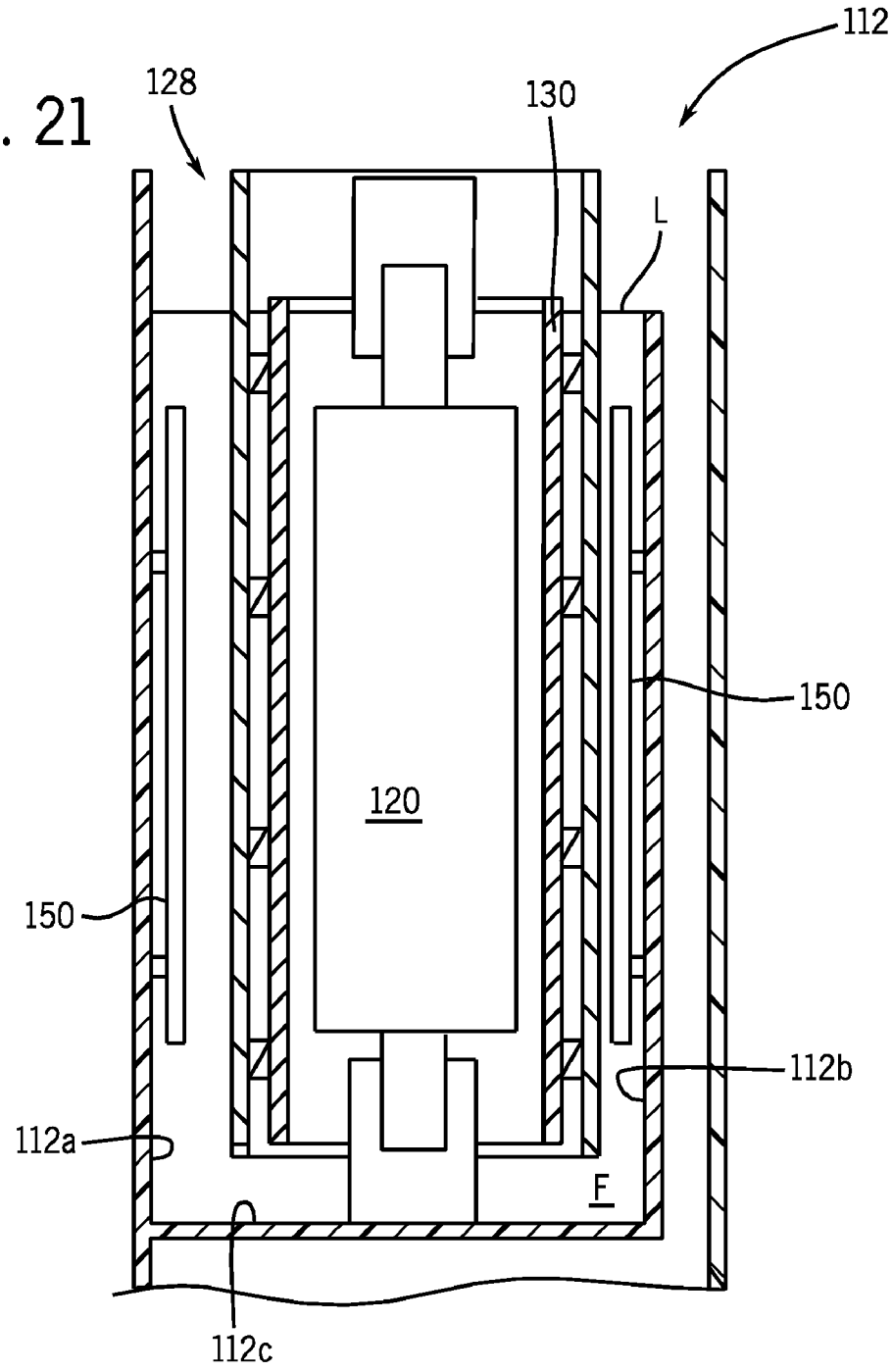
FIG. 21 is a schematic sectional elevation view of an apparatus for plating a rotogravure cylinder according to an embodiment configured to support the rotogravure cylinder in a vertical position.

According to any preferred embodiment for plating a rotogravure cylinder, the tank system and cylinder mounting and drive system are of a conventional arrangement known to those of ordinary skill in the art of rotogravure cylinder plating. (Plating stations that may be adapted to incorporate various embodiments of the present invention are commercially available, for example, from R. Martin AG of Terwil, Switzerland.) The cylinder mounting system may be configured to support cylinder 120 in a horizontal position, as shown schematically in FIG. 1, or a vertical position as shown schematically in FIG. 21.

The plating solution is itself of a composition known to those of ordinary skill in the art of electroplating; for example, for copper plating, a solution of 120 to 295, preferably 270 to 290 gram/liter copper sulfate and 40 to 80, preferably 50 to 60 gram/liter sulfuric acid, to fill plating tank 112 to level L. The plating solution may be of a composition known to those who may review this disclosure. According to an exemplary embodiment for copper plating, the plating solution may be refreshed by adding sources of copper such as copper sulfate, copper oxides, cuprous oxide etc. (such as that described in U.S. Pat. No. 5,707,438 incorporated by reference herein), or the like (e.g. copper oxide provided to the solution through the oxidation of copper) to one or both of plating tank 112 and holding tank 114.

According to some embodiments, the concentration of the plating solution is controlled by a volumetric feeder, sensor array (i.e., a Baumé sensor) in or near one or both of plating tank or holding tank. Sensor array 170 (shown schematically in FIG. 9) may be of a type known to those who may review this disclosure. According to an exemplary embodiment, the concentration of the plating solution is controlled by pumping the solution through a clear tube with an optical device hooked up to a controller (e.g., a computing device); when the controller detects a low concentration (e.g., by more light passing through the solution than the threshold) it triggers a valve to deliver or introduce (possibly from a separate container) a refreshed solution or a material that will refresh the solution (i.e., nickel, zinc, copper sulfate, copper oxide, cuprous oxide, etc.) directly or indirectly into one or both of the plating tank and holding tank; refreshing the plating solution continues until the concentration rises sufficiently to trigger the controller to shut the valve.

According to any preferred embodiment, the plating solution includes a commercially available hardening agent or hardener (e.g., DisCop commercially available from Chema Technology, Inc., Milwaukee, Wis., U.S.A. (Part number CH-DisCop)). Other suitable hardening agents can be of a composition known to those who may review this disclosure. The amount of hardening agent added to the plating solution will depend on the specific hardening agent and the manufacturer's recommendations. For example, a suitable mixing ratio for DisCop is about 7 to 8 mL hardener per gallon of plating solution. More suitably, 7.4 to 7.6 mL hardener per gallon of plating solution. In some embodiments, the hardener may be selected to be substantially chloride-free or may be selected to comprise chloride. Brighteners may also be used in the solution.

According to any preferred embodiment, anode system 128 includes a non-dissolvable anode 130 (i.e., an anode or cathode for deplating) made from a conductive material substantially resilient to the plating solution, or a conductive material including, at least partially, a surface material or treatment (or combination of surface materials and/or treatments that is substantially resilient to the plating solution) for plating or deplating an object with various metals or metallic alloys (i.e., nickel, zinc, copper, etc.) directly out of solution to produce a uniform and consistent grain structure on the surface of the object.

According to any preferred embodiment, anode system 128 is at least partially disposed into plating solution F below level L such that anode system 128 will remain in electrical contact with plating solution F during the plating process. In some embodiments, non-dissolvable anode 130 can be disposed into solution F below level L.

Figure 14:
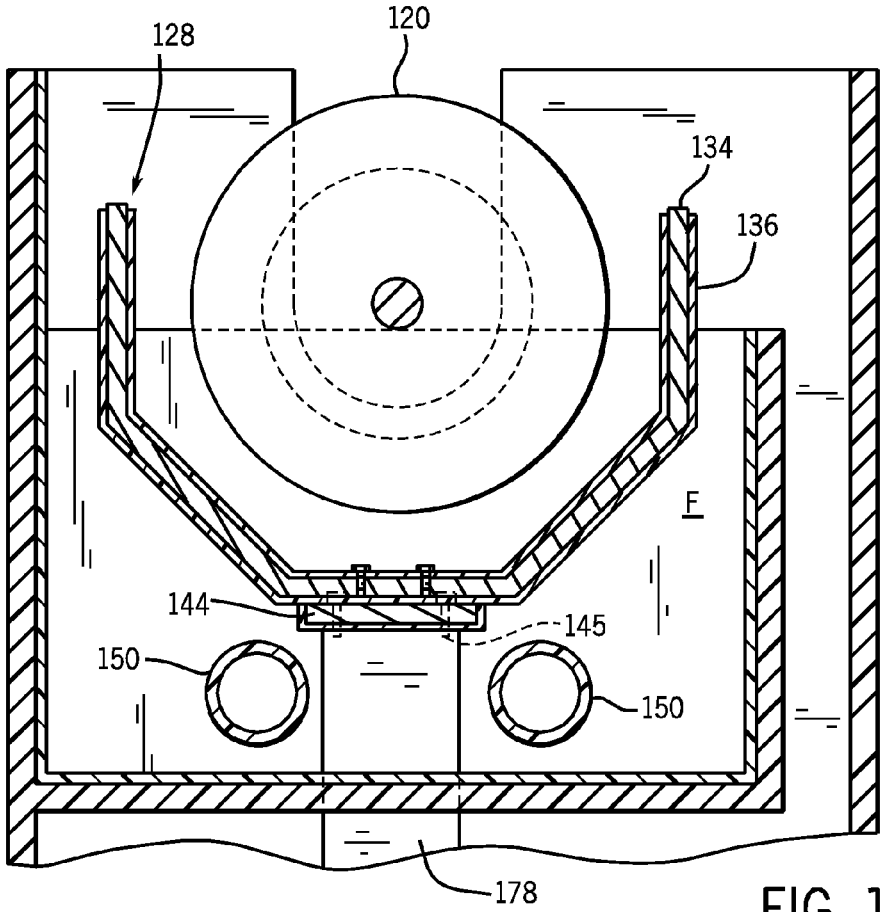
FIG. 14 is a schematic sectional end elevation view of an apparatus for plating a rotogravure cylinder according to an alternate embodiment employing a non-dissolvable anode supported from beneath.

Anode system 128 may include a continuous anode (i.e., a conductive plate disposed near cylinder 120), a plurality of anodes coupled to or contacting one another, or a plurality of independent anodes separately coupled to a power supply. As shown schematically in FIGS. 1, 9 and 22, and 39 anode system 128 is electrically coupled to at least one current carrying rail 144 (e.g., bus bar). In an exemplary embodiment, anode system 128 is mechanically coupled to a pair of rails 144, which are shown extending along walls 112*a* and 112*b* of plating tank 112. (Rails 144 are shown mounted from a reinforcing structure 141 in FIG. 1; according to an alternative embodiment, the ends of the rails may be supported by the tank ends or side walls.) Alternatively, as shown in FIG. 14, anode system 128 may be electrically coupled and mechanically supported from beneath by rail 144 (which is in turn electrically coupled and mechanically supported by column 178) electrically coupled to anode system 128. As shown in FIGS. 1 and 9, anode system 128 is mechanically fastened and electrically coupled to rail(s) 144 at junctions employing fasteners 145, shown as bolts.

Figure 8:
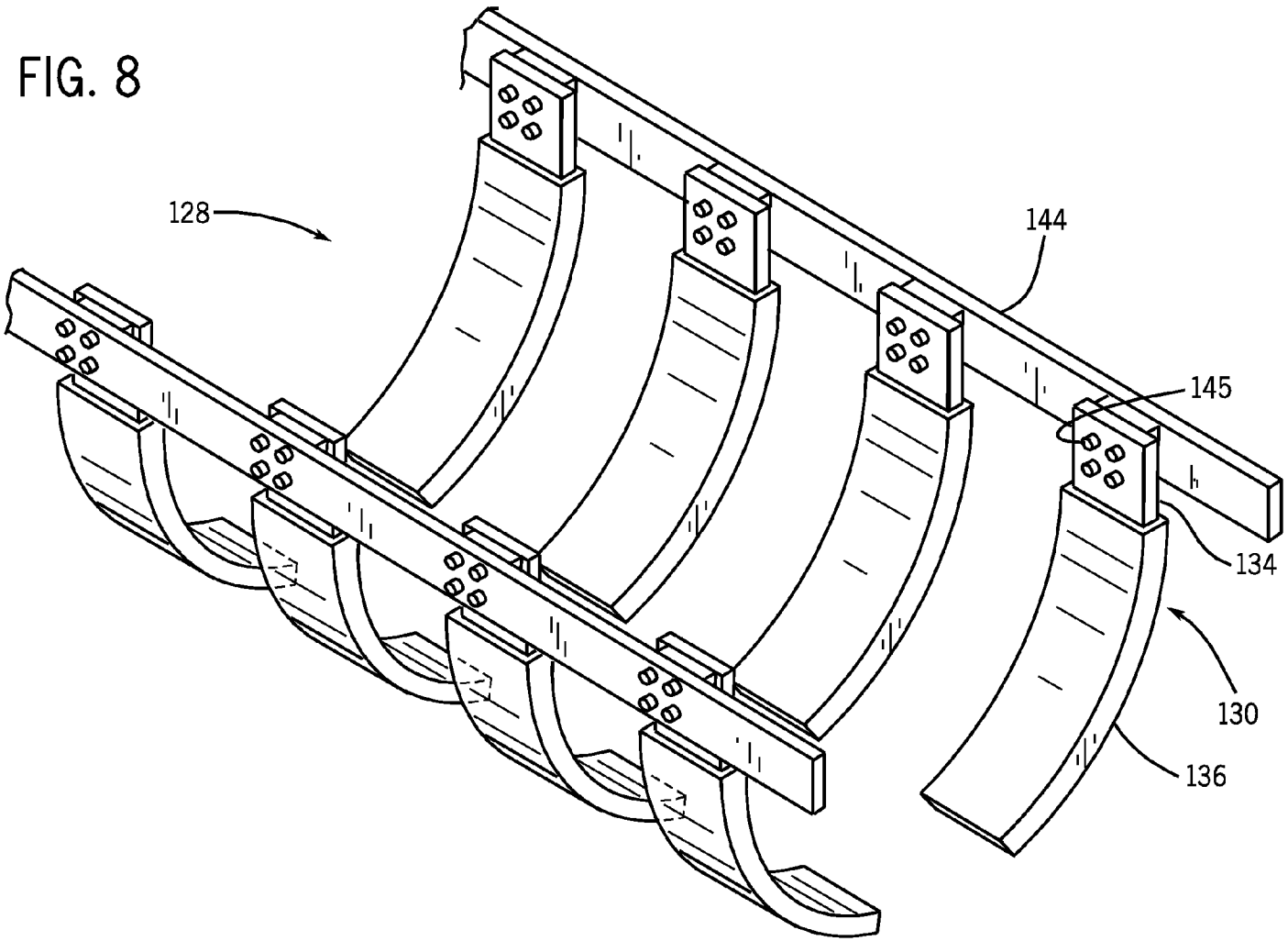
FIG. 8 is a fragmentary perspective view of the non-dissolvable anode of FIG. 6.
Figure 20:
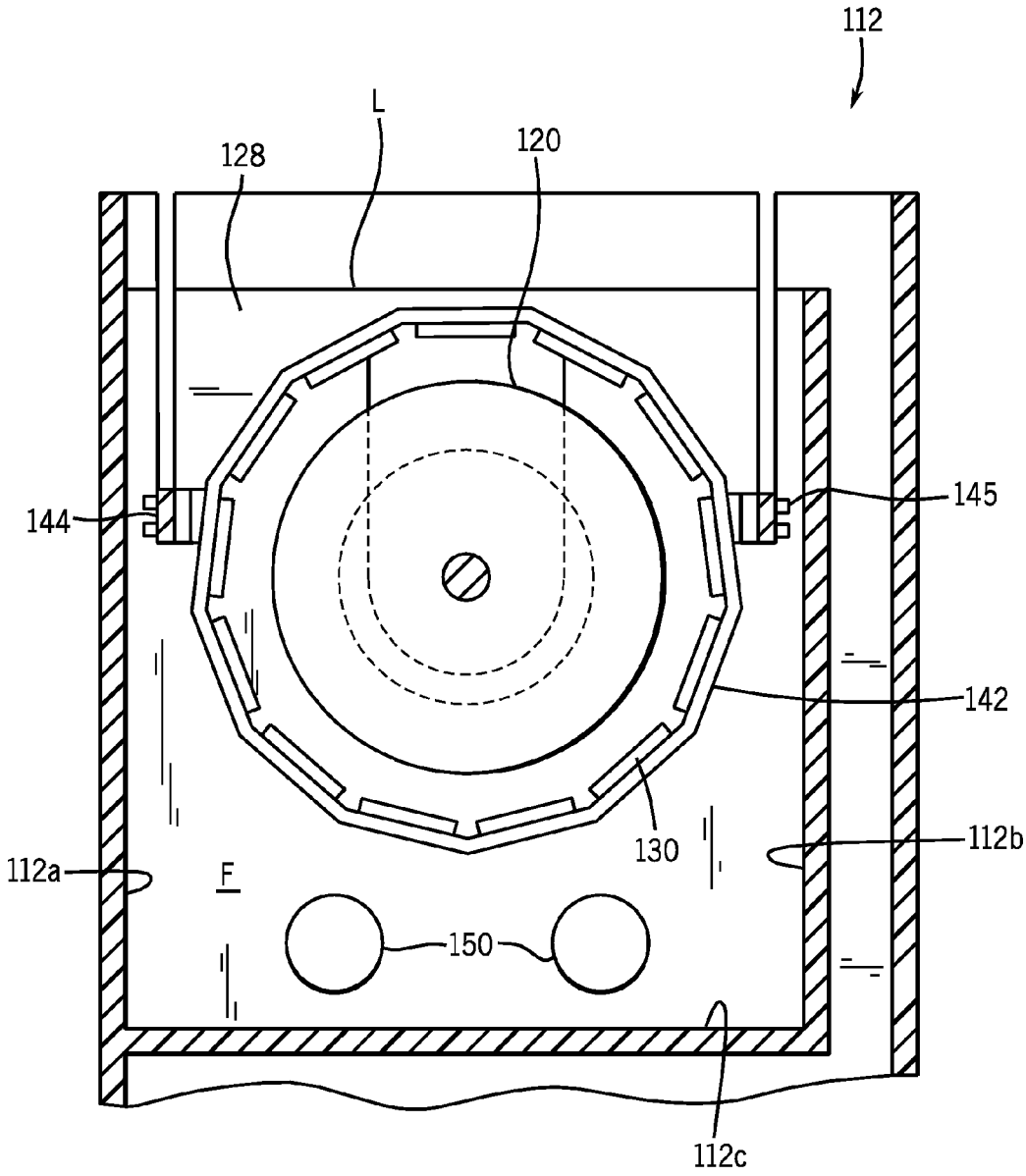
FIG. 20 is a schematic sectional elevation view of an apparatus for plating a rotogravure cylinder according to an embodiment employing a non-dissolvable anode ring.

According to an exemplary embodiment, shown schematically in FIG. 39, anode system 128 does not encompass any substantial portion of the outer perimeter of cylinder 120. This relationship may vary in alternative embodiments, such as those shown in FIGS. 18 and 20 which employ an anode system of a larger size or greater surface area relative to cylinder 120. According to an exemplary embodiment, shown schematically in FIGS. 8 and 12, anode system 128 is disposed around each side of cylinder 120 and follows the general shape or curve of cylinder 120. As shown schematically in FIGS. 6, 10, 14, 23, 24, 29, 30, 39, and 41 anode system 128 may extend partially around cylinder 120. Alternatively, as shown schematically in FIG. 20, anode system 128 may extend substantially or fully around cylinder 120.

According to a particular embodiment, anode system 128 includes a heavier weight anode, an increased number of anodes, or a surface material such that the total anode weight or surface area (or cathode weight or surface area for deplating) is increased to provide for greater efficiency (and consistency) in the electroplating process by allowing usage of an increased current density (i.e. higher amperage and lower voltage). Typically, an increased current density reduces the plating time but increases the number or duration of additional polishing steps. However, utilizing an anode system having a non-dissolvable anode 130 with an increased current density not only reduces the plating time, but also minimizes the number or duration of additional polishing steps by reducing the amount of metallic sludge in the plating tank that may adhere to the cylinder and may cause uneven or undesirable deposits.

According to any preferred embodiment, anode system 128 includes at least one non-dissolvable anode 130 made from a conductive material substantially resilient to the plating solution (e.g., graphite, silver, titanium, platinum), or a conductive core 134 (e.g., lead, copper, titanium, etc.) covered, at least partially, by a protective a surface material 136 that is substantially resilient to the plating solution. While portions of anode system 128 may be coated with a nonconductive protective surface material 137, at least portions of anode system 128 should include a conductive protective surface material 135 (e.g., graphite, titanium, platinum, silver conductive metal oxides or combinations thereof) that will maintain electrical contact between anode system 128 and plating solution F. The non-dissolvable anode may include a protective surface material or a combination of protective surface materials (e.g., a sleeve, wrap, surface treatment, powder coating, spray coating, brushing, dipping, sealing, powder coating, washing etc.) along its entire surface area, along a substantial portion of its surface area, or along only part of its surface area. According to other alternative embodiments, the surface material may include a material (e.g., a sheet, slat, strip, wrap, etc.) coupled to (e.g., adhered, welded, wrapped, shrunk, applied to or fastened by mechanical fasteners or otherwise, etc.) the core 134. According to some embodiments, at least those portions of the anode system that may be exposed to corrosion or chemical attack by the plating solution (electrolytic fluid F) will be made from a material that is substantially resistant to the plating solution or include a protective surface material that is substantially resistant to the plating solution.

Figure 11:
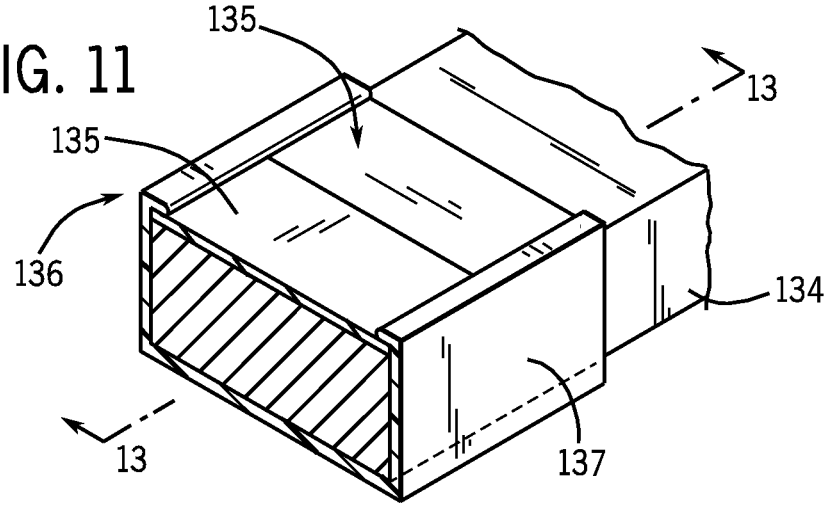
FIG. 11 is a fragmentary perspective view of a conductor including a conductive surface material and a non-conductive surface material.
Figure 12:
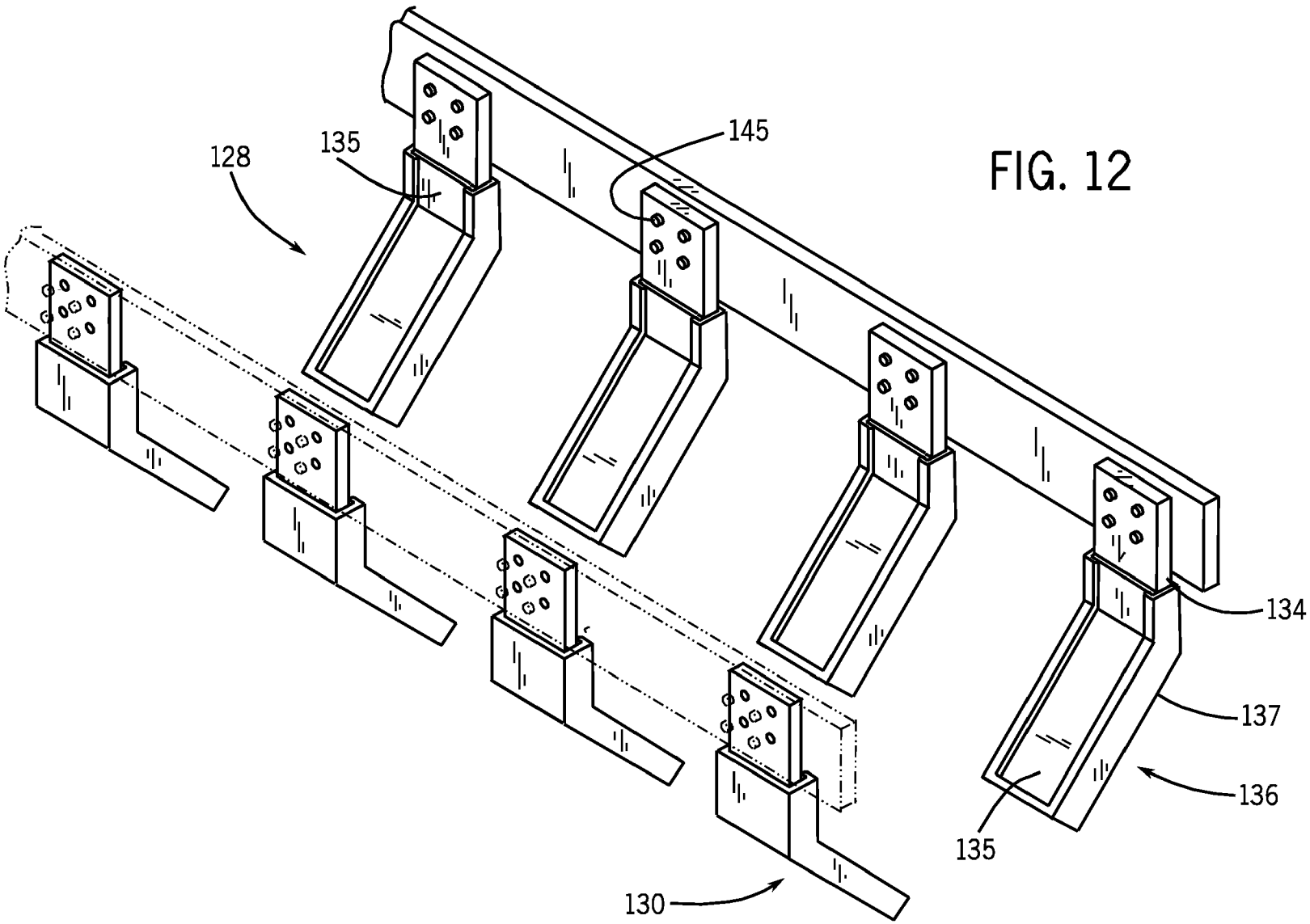
FIG. 12 is a fragmentary perspective view of the non-dissolvable anode of FIG. 10.
Figure 13A:
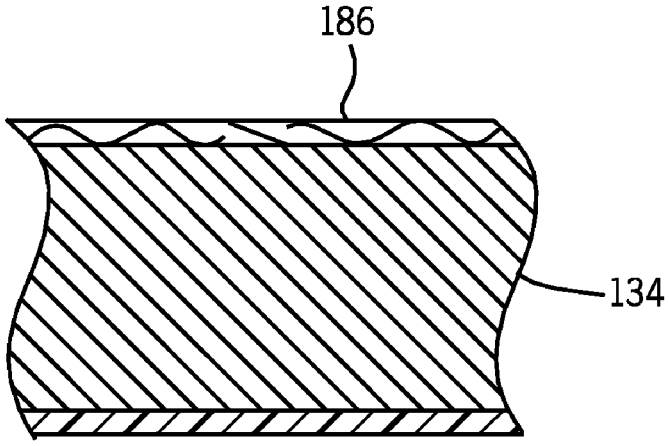
FIG. 13*a* is a sectional view of the conductor of FIG. 11 taken through line 13 showing an angled abutment of the surface material.
Figure 13B:
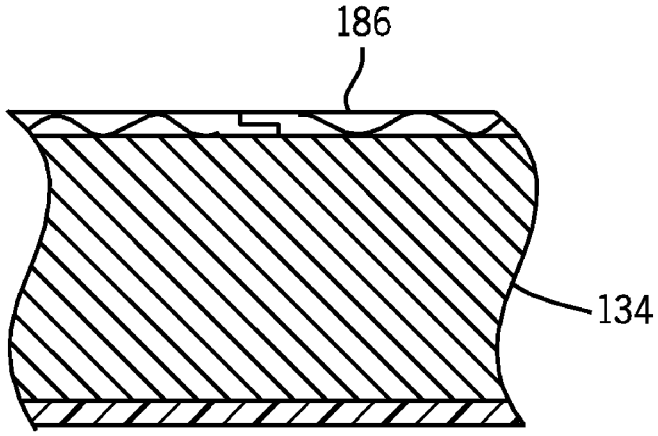
FIG. 13*b* is a sectional view of the conductor of FIG. 11 taken through line 13 showing an stepped abutment of the surface material.
Figure 13C:
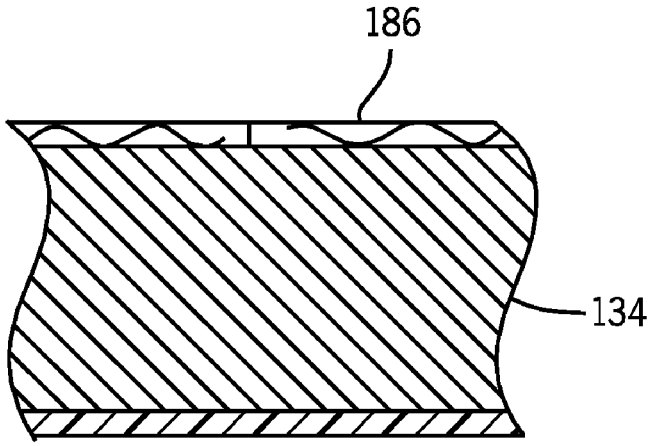
FIG. 13*c* is a sectional view of the conductor of FIG. 11 taken through line 13 showing a straight abutment of the surface material.
Figure 15:
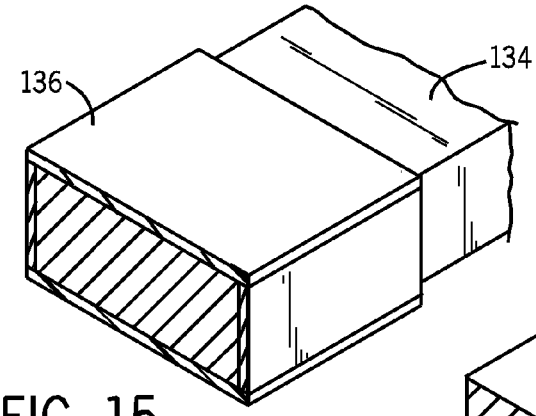
FIG. 15 is a fragmentary perspective view of a conductor including a conductive surface material.
Figure 16:
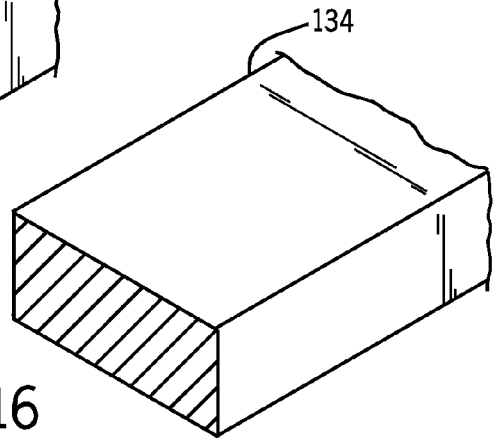
FIG. 16 is a fragmentary perspective view of a conductor.
Figure 17:
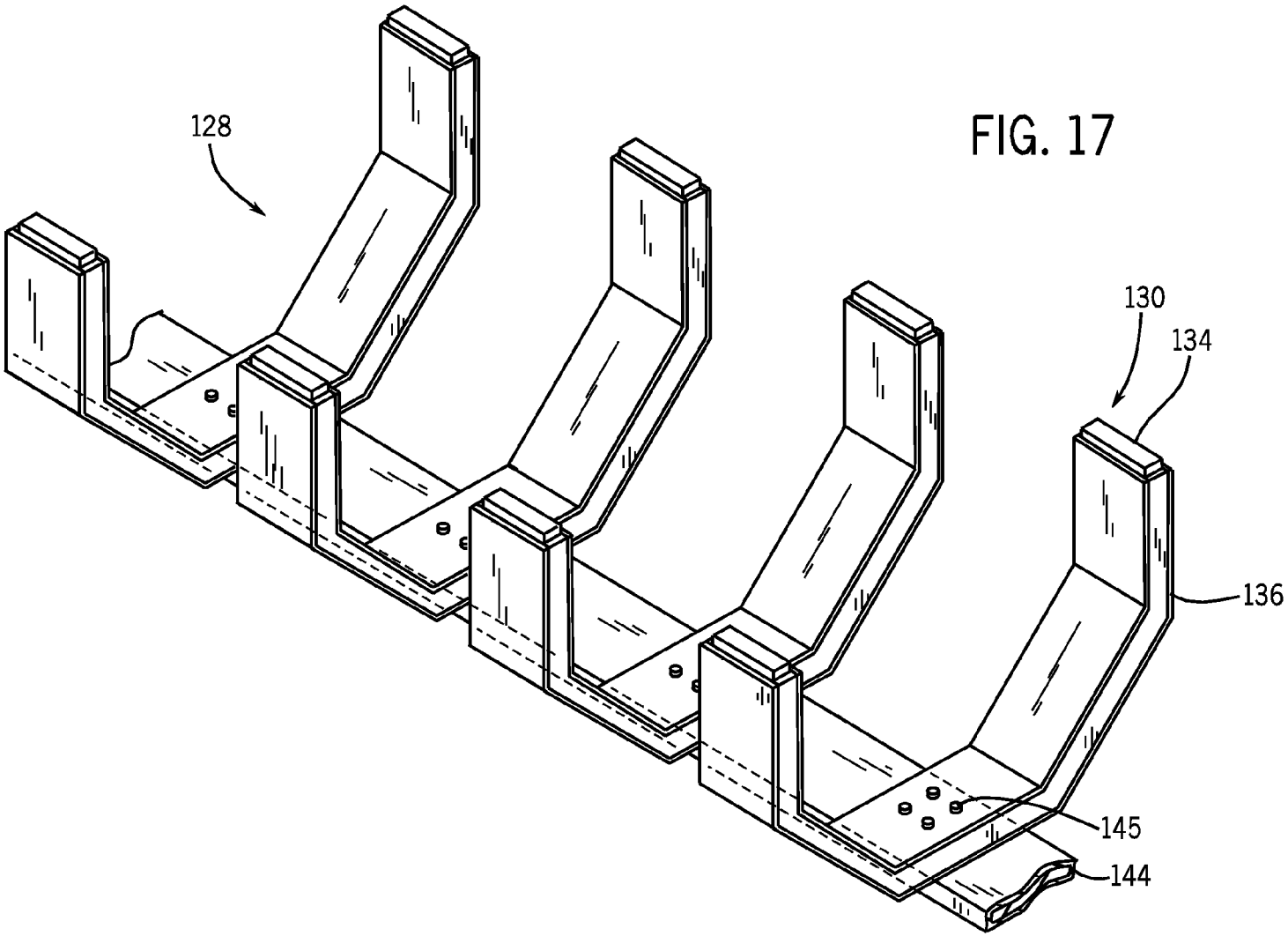
FIG. 17 is a fragmentary perspective view of the non-dissolvable anode of FIG. 14.

In an exemplary embodiment, core 134 is protected, at least partially, by a surface material 136 formed from (at least partially) a conductive surface material (e.g., graphite). Conductive surface material 135 may extend along the entire length of conductive core 134 or along a portion of conductive core 134. In an exemplary embodiment, a plurality of conductive surface material pieces 186 are used to at least partially cover core 134. As shown in FIG. 13, where a plurality of pieces 186 is used, pieces 186 may be adjoined using a angled abutment (depicted in FIG. 13*a*), a stepped abutment (depicted in FIG. 13*b*), a straight abutment (depicted in FIG. 13*c*), or any other configuration that may be known to those who may read this description. According to any exemplary embodiment, non-dissolvable anode 130 may include conductive surface material 135 coupled to a portion of core 134 as shown in FIG. 12, or, as shown in FIG. 15, coupled to multiple surfaces of core 134. In an alternate embodiment, portions of core 134 not covered by sheet material 186 may be covered, at least partially, by non-conductive material 137. In an exemplary embodiment, to create a seal between conductive surface material 135 and non-conductive surface material 137, non-conductive material 137 wraps around the edges of conductive surface material 135, as shown in FIG. 11. Other methods may also be used to create a seal between conductive surface material 135, non-conductive material 137, or other materials constituting surface material 136.

Alternatively, graphite is applied to protect core 134 using a spray or powder coating. According to a particularly preferred embodiment, protective surface material 136 includes coating or wash having a graphite content of more than 10 percent, and preferably a graphite content of more than 20 percent such as GRAPHOKOTE NO. 4 LADLE COATING (trade name with product data sheet Pds-G332 incorporated by reference herein), commercially available from Dixon Ticonderoga Company of Lakehurst, N.J., U.S.A. According to any preferred embodiment, the protective surface material (e.g., graphite) is securely applied to core 134.

According to an alternative embodiment, shown in FIG. 40, anode system 128 includes a conductive core 134 and a layered protective surface material 136. According to some embodiments, the protective surface material includes a valve metal base 262 and a conductive metal oxide coating 264. According to some embodiments the conductive metal oxide coating can include at least one platinum-group metal or platinum-group metal oxide and at least one valve metal or valve metal oxide. Exemplary platinum-group metals and oxides thereof include, but are not limited to, ruthenium, ruthenium oxide, osmium, osmium oxide, rhodium, rhodium oxide, iridium, iridium oxide, palladium, palladium oxide, platinum and platinum oxide. Exemplary valve metals and oxides thereof include, but are not limited to, tantalum, tantalum oxide, titanium, titanium oxide, zirconium, and zirconium oxide. According to some embodiments, the protective surface material includes mixtures of metal oxides (e.g., iridium oxide and tantalum oxide). Exemplary conductive metal oxide coatings are described in U.S. Pat. No. 4,585,540 incorporated by reference herein, and U.S. Pat. No. 6,217,729 incorporated by reference herein. According to a particularly preferred embodiment, the conductive metal oxide coatings may include those commercially available from Eltech Systems Corporation of Fairport Harbor, Ohio, U.S.A. The conductive metal oxide coating can be applied to the valve metal base according to conventional procedures known to those who may read this disclosure.

According to any preferred embodiment, the valve metal base includes titanium. The titanium base may include the conductive core 134 or an intermediate titanium layer (e.g., 260 or 262). As shown in FIG. 40, the conductive metal oxide coating 264 can be applied to the titanium base 262 which is applied to the conductive core 134 via a conductive intermediate layer 260 (e.g., platinum, titanium, etc.). According to an alternative embodiment, the titanium base 262 is applied directly to the conductive core 134. According to some embodiments, the titanium base includes a titanium spray coating 262 securely applied to at least potions of the conductive core 134. A spray coating may be selected to create a rough surface, which may increase the surface area of anode 130. Some embodiments will increase the surface are of anode 130 by more than about 50 percent. A particularly preferred embodiment will increase the surface area of anode 130 by more than about 100 percent.

According to any exemplary embodiment, anode 130 may include multiple layers of surface materials. For example, anode 130 may include a conductive core 134 at least partially covered by a first layer (e.g., platinum, titanium, silver, graphite, etc.) and at least partially covered by a second layer (e.g., platinum, titanium, silver, graphite, conductive metal oxide, etc.). Some embodiments may include a first layer of titanium and a second layer of platinum. Some embodiments may include a first layer of titanium and a second layer of conductive metal oxide. According to an alternate embodiment, additional layers can be employed.

Figure 18:
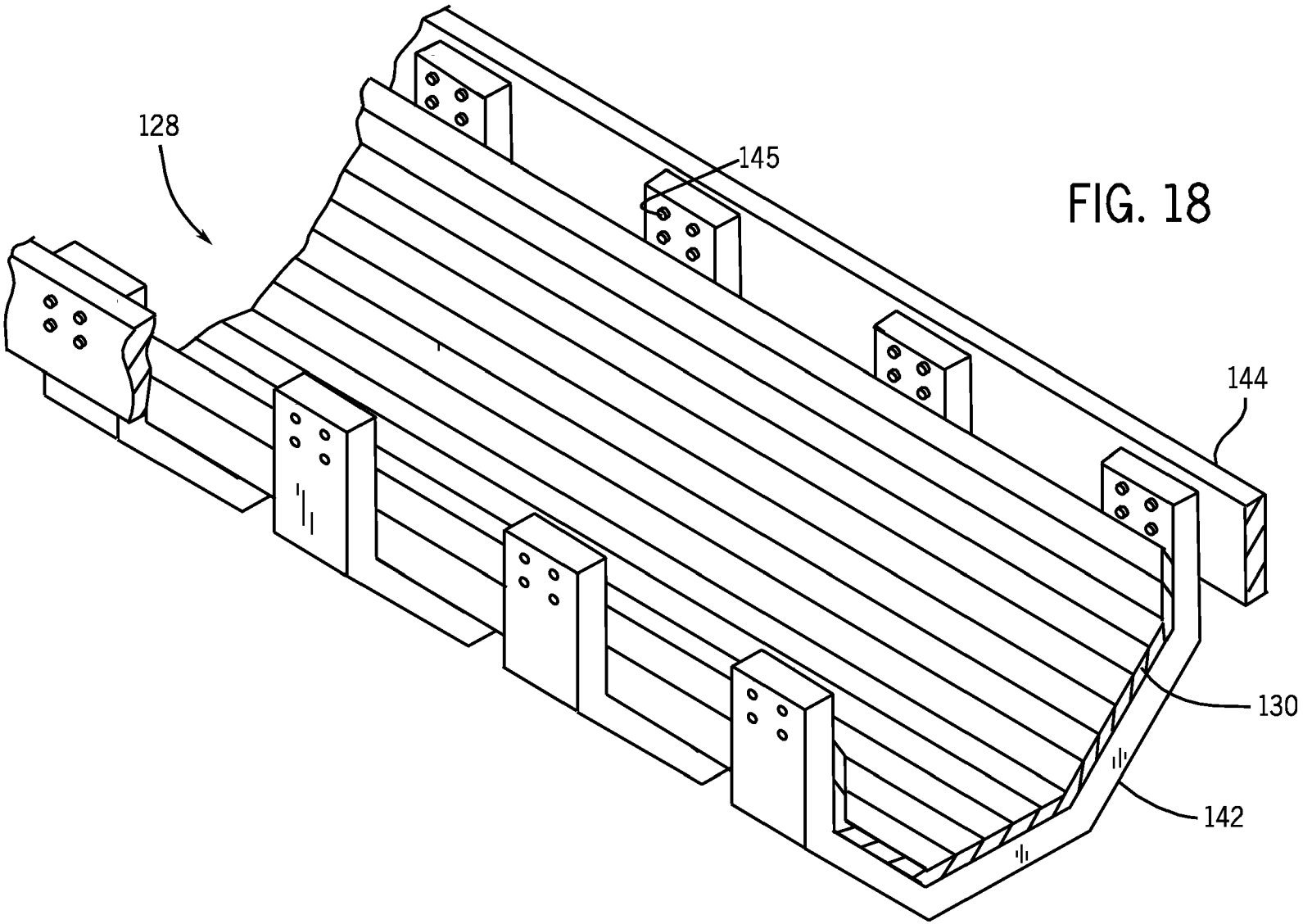
FIG. 18 is a fragmentary perspective view of a non-dissolvable anode according to an alternate embodiment.
Figure 19:
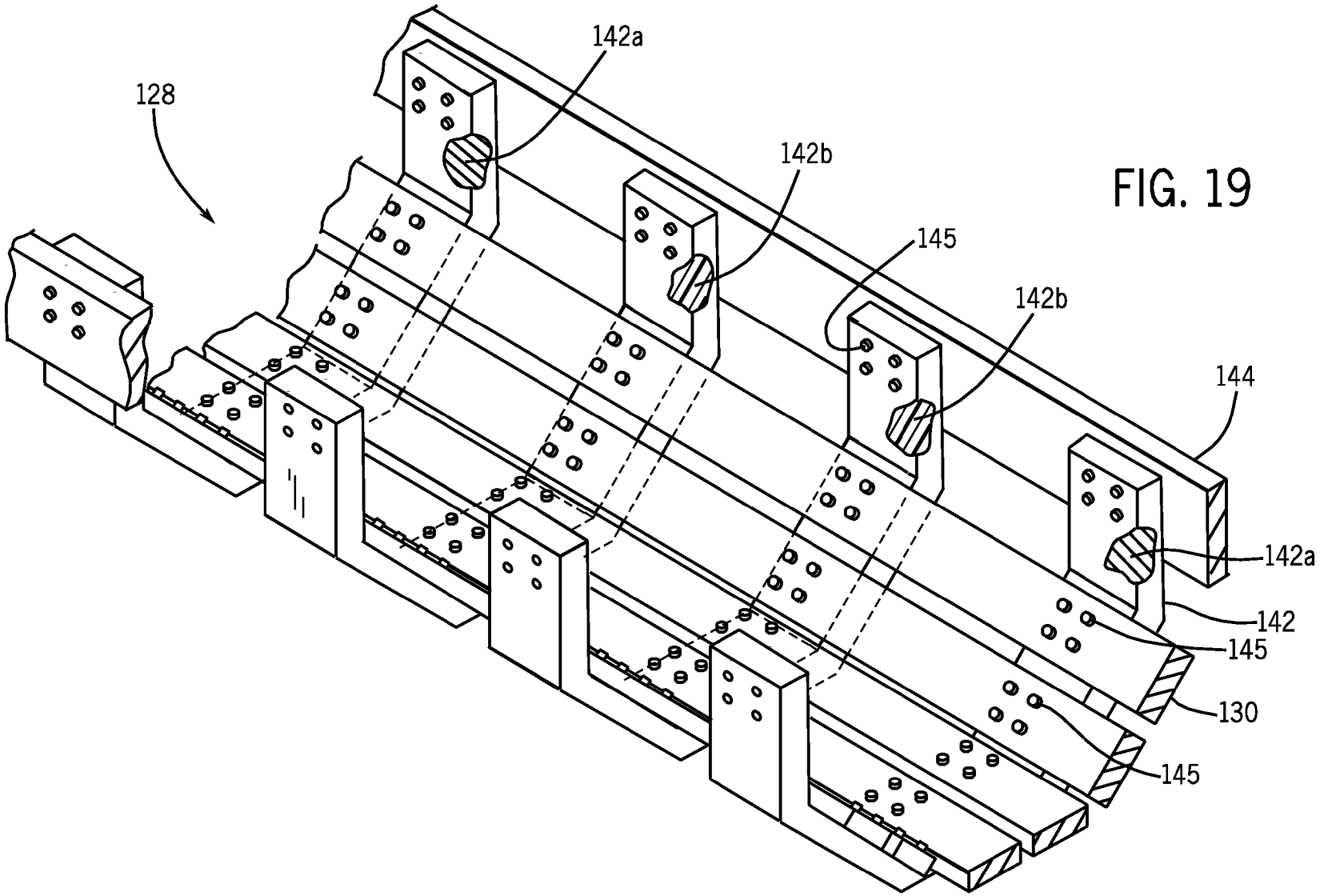
FIG. 19 is a fragmentary perspective view of the non-dissolvable anode according to an alternate embodiment.

According to an alternate embodiment, shown in FIGS. 18 and 19, anode system 128 includes a non-dissolvable anode 130 that is entirely composed of a conductive material substantially resilient to the plating solution (e.g. graphite commercially available, for example, from Schunk Graphite Technology of Menomonee Falls, Wis.). As shown in FIGS. 18 and 19, anode system 128 includes a plurality of support members (e.g., a curved or angled supporting plate or at least one curved or angled flat supporting strip, some of which may be made using a nonconductive material) mechanically fastened and electrically coupled to a plurality of non-dissolvable anodes 130. In an exemplary embodiment, shown in FIG. 19, graphite non-dissolvable 130 are coupled to support members 142 using fasteners 145, shown as screws. According to any embodiment, particularly those where graphite is used, preferably at least portions of the anode system are sealed (preferably high pressure sealing commercially available, for example, from Schunk Graphite Technology of Menomonee Falls, Wis.) or baked. According to some embodiments, support members 142 and non-dissolvable anodes 130 are connected using fasteners 145 (shown as screws) made of a material that is substantially resilient to the plating solution (e.g., graphite).

Figure 45:
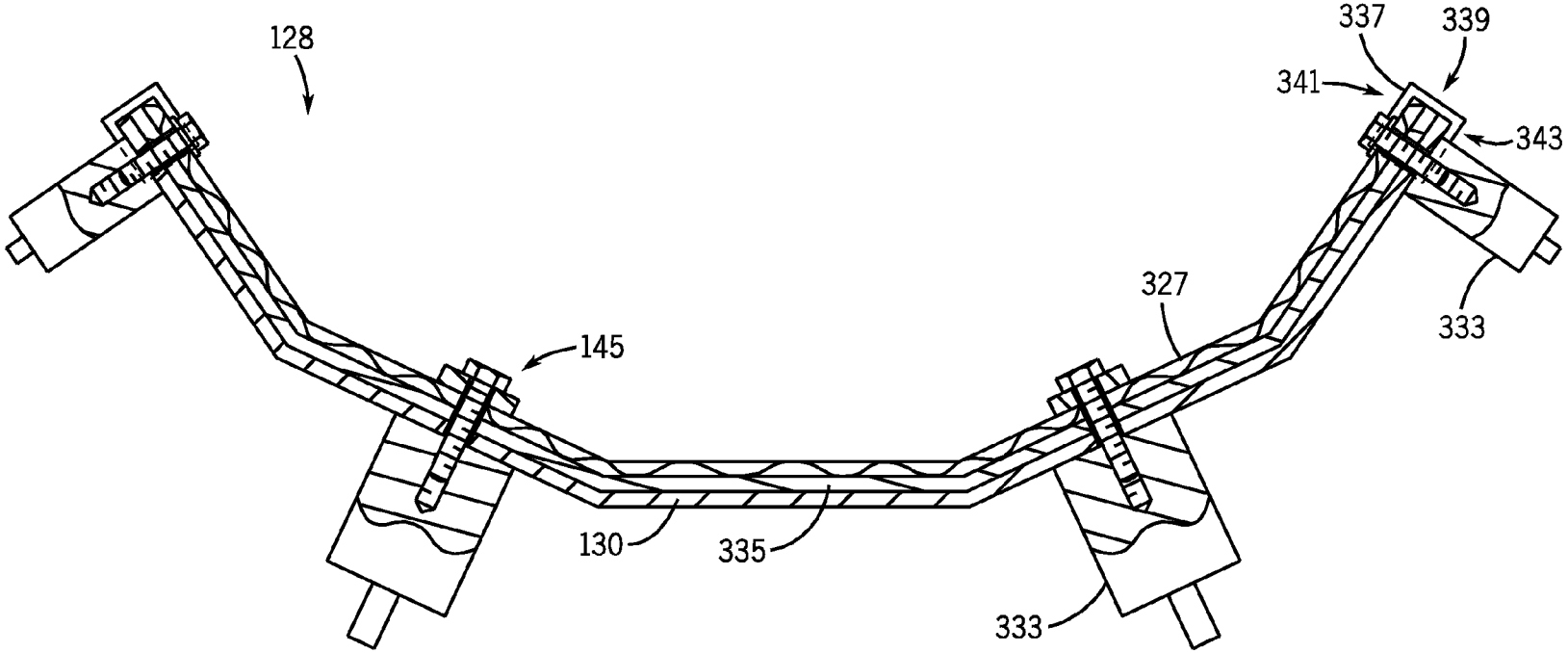
FIG. 45 is a schematic of an anode assembly according to some embodiments.

Referring to FIG. 45, according to any embodiment, the anode system 128 may include a body 327 placed between anode 130 and the object to be plated. Body 327 may be a substantially planar body such as a sheet. Body 327 may have an open configuration (e.g. a mesh) or a closed configuration. Body 327 may be a non-conductive body made from a substantially non-conductive material (e.g. a plastic and/or polymer such as polypropylene). Body 327 may be sufficiently rigid such that it provides support to anode 130, or may be flexible (i.e. not rigid). Anode system 128 may also include a second body 335 which may have any of the properties discussed above for body 327. Body 335 may be the same as or may be different (in whole or in part) from body 327.

Anode system 128 may also include edge protectors 337. Edge protectors 337 may be made from a non-conductive material and may cover at least a portion of one or more of the end 339 of anode 130, a forward edge 341 of anode 130, and/or a back edge 343 of anode 130. Edge protectors 337 may wrap around anode 130 or may be composed of separate components (e.g. separate components on different sides of anode 130) which together form an edge protector. Edge protector may be close to an object being plated than one or more of anode 130, body 327, and body 335 such as each of anode 130, body 327, and body 335. In some embodiments, edge protector 337 may effectively wrap around each of anode 130, body 327, and body 335.

Fasteners 145 may be used to hold one or more of anode 130, body 327, and body 335 against a support 333. Support 333 may provide mechanical and/or electrical support to anode 130, body 327, and body 335. Fasteners 145 may be formed from a non-conductive material. Support 333 may be formed from a non-conductive material and may include a conducive, current-transferring element within the non-conductive material. In some embodiments, support 333 may be almost entirely formed from non-conductive material. In some embodiments, support 333 may be almost entirely formed from conductive material. Different supports 333 may be included where two or more supports may have different configurations and functions than each other (e.g. one may be at least partially conductive and provide electrical and mechanical support while another might be substantially non-conductive and may provide mechanical support). All such combinations of supports 333 are contemplated.

Figure 42:
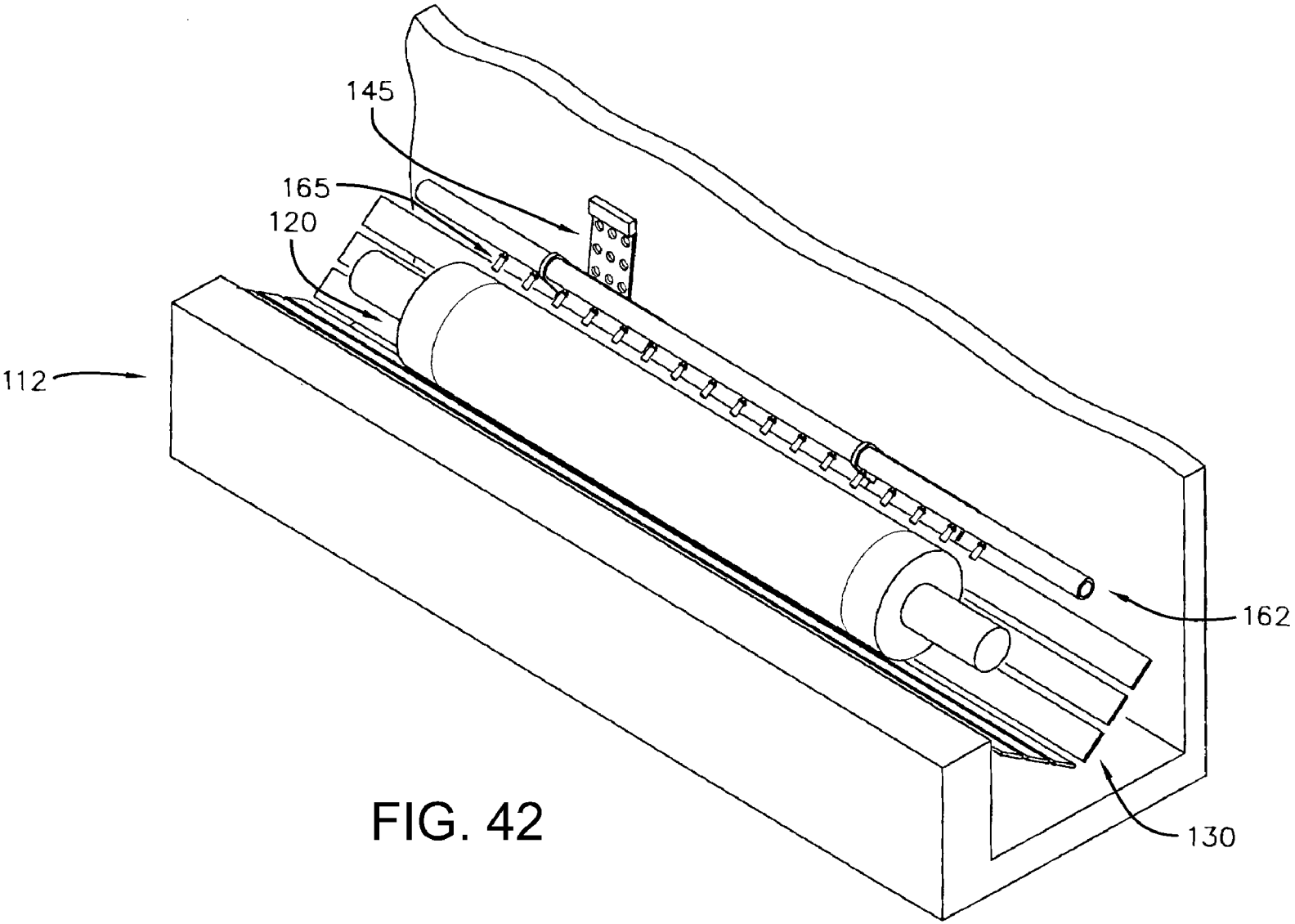
FIG. 42 is a fragmentary perspective view of the plating apparatus according to one embodiment.
Figure 43:
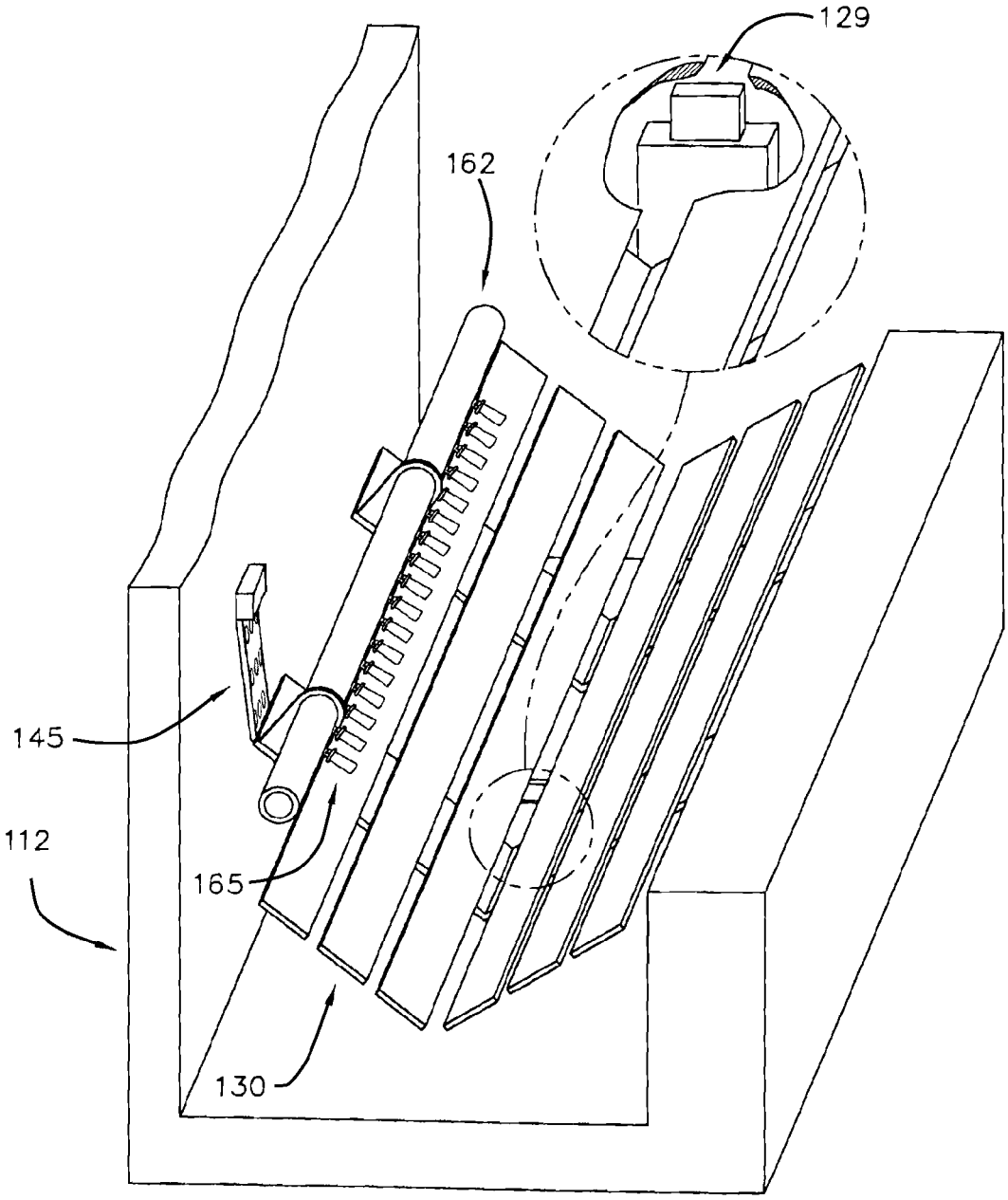
FIG. 43 is a fragmentary perspective view of the plating apparatus according to the embodiment of FIG. 42.
Figure 44:
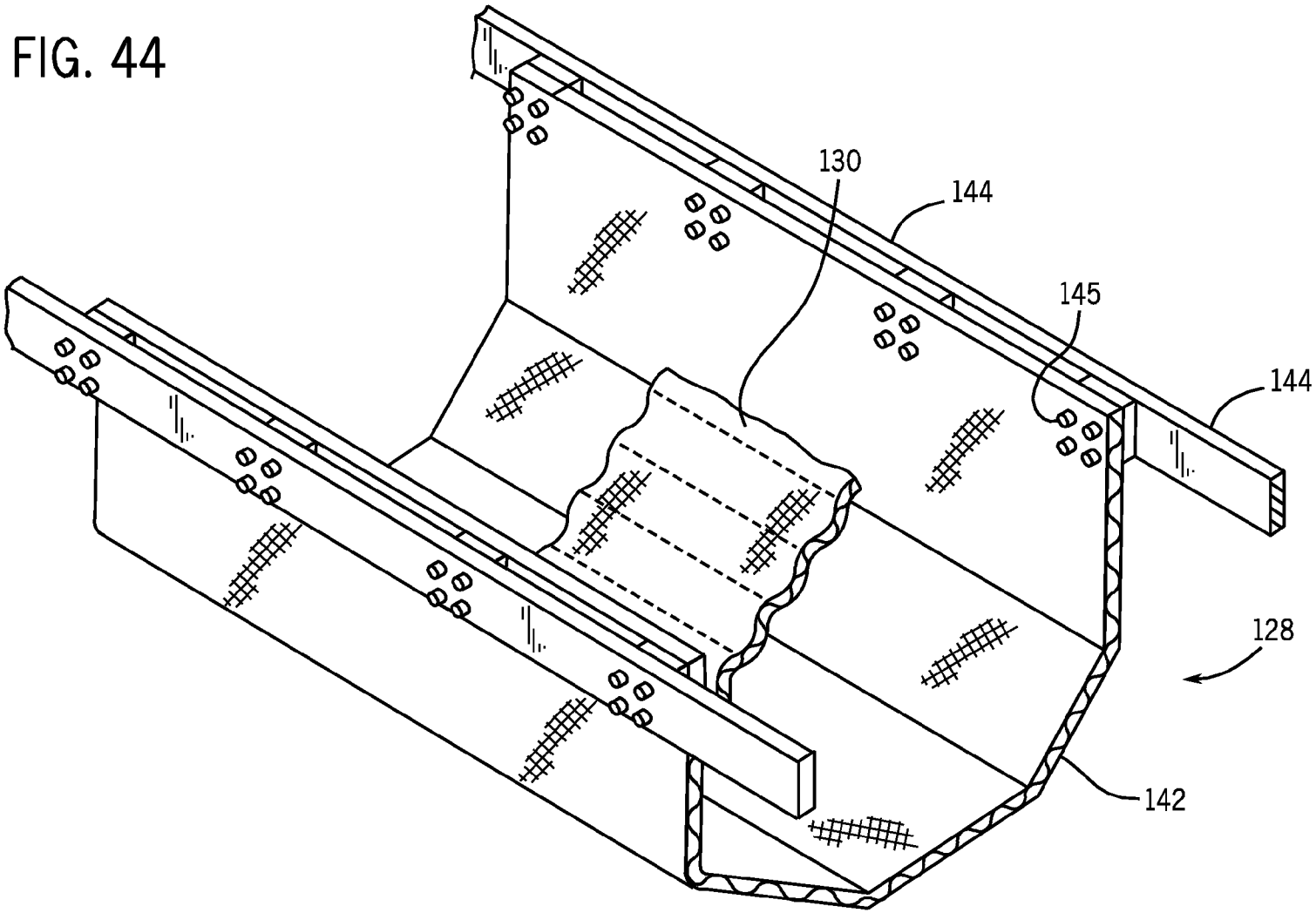
FIG. 44 is a fragmentary perspective view of a non-dissolvable anode according to an alternate embodiment.
Figure 46:
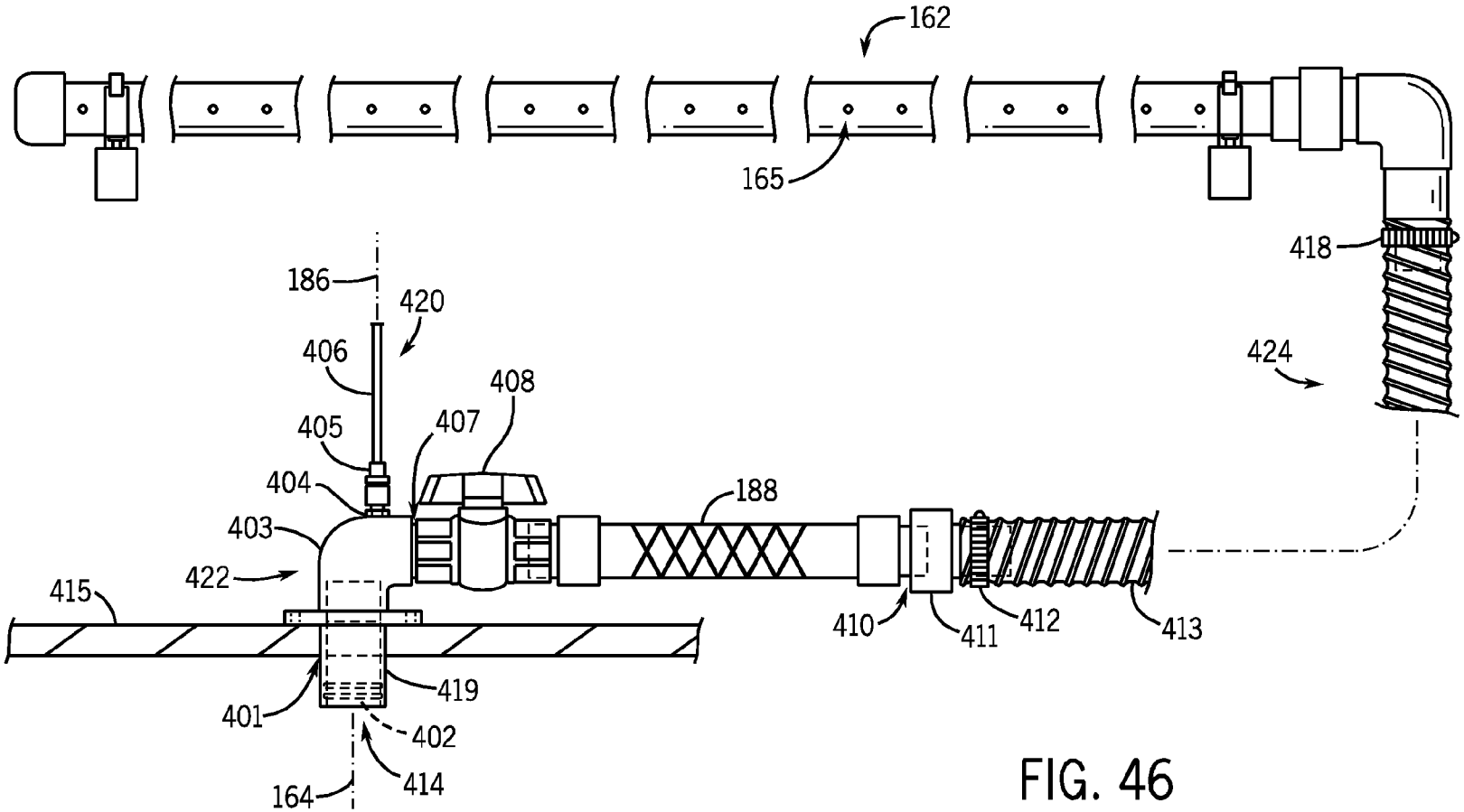
FIGS. 46 and 47 are schematics of a mixing system according to some embodiments.
Figure 47:
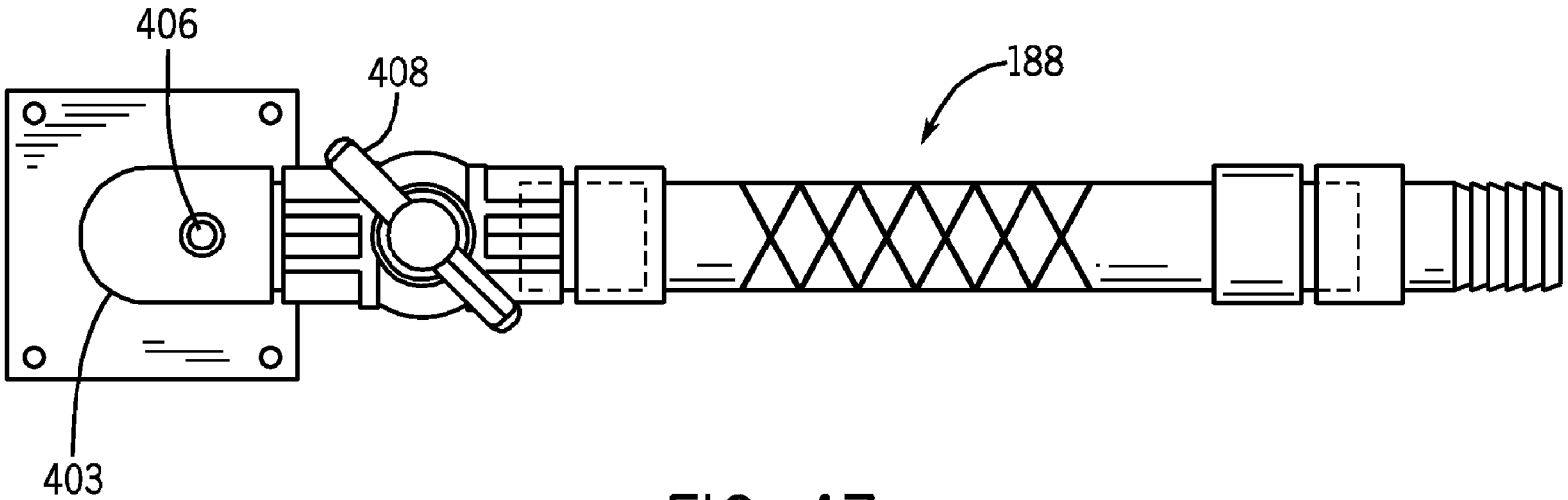

Referring to FIGS. 46 and 47, according to any embodiment hardener may be mixed with plating solution and the combined plating solution and hardener may be sprayed on or near the object to be plated. According to any embodiment, the hardener may be provided into the plating tank 112 (FIG. 1). In some of these embodiments, a hardener connection system 420 is connected to a source of hardener 186 and a plating solution connection system 422 is connected to a source of plating solution. The hardener connection system 420 and the plating solution connection system 422 are connected such that hardener provided from the source of hardener 186 and the plating solution are mixed. More thorough mixing may be further facilitated by the use of a mixer 188 such as an in-line mixer. Mixed hardener and plating solution may be provided to the plating system in any manner. In some embodiments, the mixture may be provided to spray bar 162 using a spray bar connection system 424. Spray bar 162 may include nozzles 165 configured to provide plating solution directly on or near the object to be plated (e.g. a rotogravure cylinder) as shown in FIGS. 42 and 43. Force for providing a spray from spray bar 162 may be provided by a pump, such as pump 164. The pump 164 may be located in holding tank 114, plating tank 112, and/or some other area (e.g. a dosing tank 180).

In some embodiments, hardener connection system 420 may include tubing 406 connected to a dosing pump (not shown) connected to the source or hardener 186. Tubing 406 may be connected to an elbow 403 through a tube fitting 405 connected to a check valve 404. In some embodiments, plating solution connection system 422 may include a pipe 419 connected to a source of plating solution (e.g. a pump 164 configured to pump plating solution from a tank such as holding tank 114 or plating tank 112) and/or connected to elbow 403. In some embodiments, system 422 may be connected to a tank (e.g. plating tank 112) and may be connected using a tank floor adapter 401.

In some embodiments, the hardener and the plating solution may be combined in a pipe such as elbow 403. This combination may provide some initial mixing to the hardener and the plating solution. In some embodiments, the system may only include this single stage of mixing before being provided to the plating system in general (e.g. through spray bar 162). However, in some embodiments a second stage of mixing may be provided (e.g. using a device configured for mixing such as an in-line mixer 188). In some embodiments, the two stages of mixing (and/or the first stage of mixing and the system 424) may be connected to each other through a pipe nipple 407 and/or a valve 408 (e.g. a ball valve which may be manual and/or may be controlled automatically such as by a controller—which may be the same or different controller than any of the controllers discussed elsewhere in this application).

In some embodiments, spray bar connection system 424 may include a reducer 410, an adapter 411 (e.g. a hose adapter), tubing 413 (e.g. a flexible tubing such as a flexible hose), a connector 412 (e.g. a clamp such as a hose clamp) configured to hold tubing 413 to adapter 411, and/or a connector 418 (e.g. a clamp such as a hose clamp) configured to hold tubing 413 to a portion of the spray bar 162 assembly.

While illustrated as a system for mixing hardener, the system and/or processes described with respect to FIGS. 46 and 47 could be used for mixing any material/additive added to the plating system.

For example, in some embodiments, an acidic rinse solution may be applied after plating to deoxidize cylinder 120. Such a solution might comprise an aqueous solution about 0.5 to about 5 weight percent sulfuric acid. The system and or processes described with respect to FIGS. 46 and 47 could be used for mixing and delivering the solution, preferably using spray bar 162. After cylinder 120 is deoxidized, it may be rinsed with, for example, deionized water.

According to any preferred embodiment, the contact surfaces between anode system 128 and current carrying rails 144 are maintained free of any surface material that may materially diminish the electrical current flowing between non-dissolvable anode 130 and current carrying rails 144. Likewise, according to some embodiments the contact surfaces of the anode system 128 are maintained free of any surface material that may materially diminish the electrical current (i.e., contact between support members 142 and non-dissolvable anode 130). According to an exemplary embodiment, contact surfaces include a conductive surface material (e.g., platinum, titanium, etc.) on at least one of the contact surfaces (i.e., contact surfaces between support members 142 and non-dissolvable anode 130).

Figure 23:
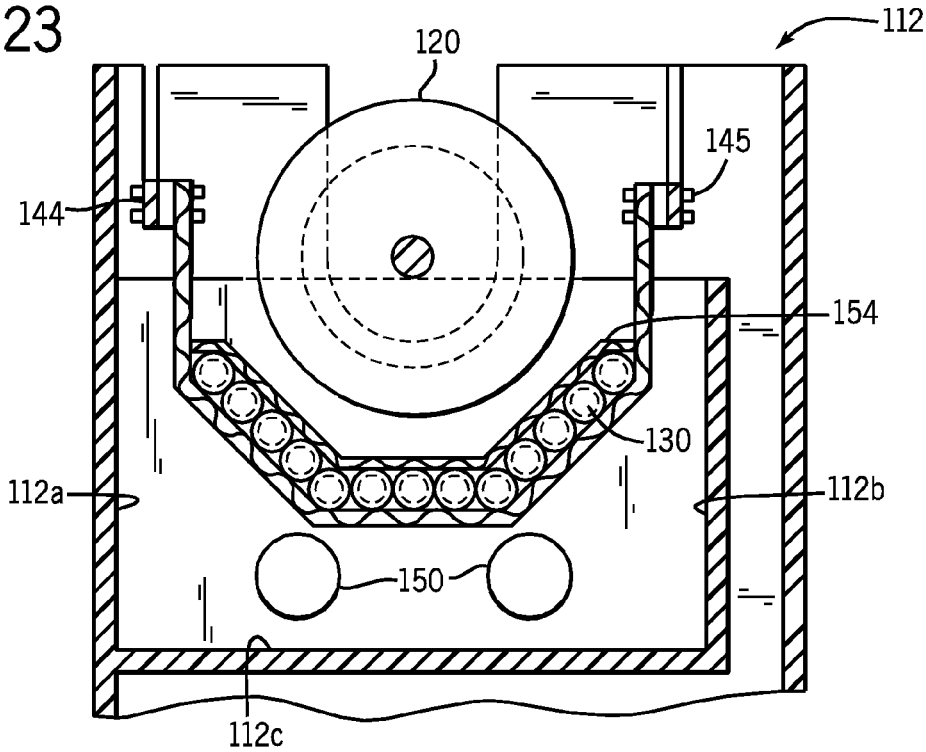
FIG. 23 is a schematic sectional end elevation view of an apparatus for plating a rotogravure cylinder directly out of a plating solution according to an embodiment employing an alternate embodiment of a non-dissolvable anode.
Figure 24:
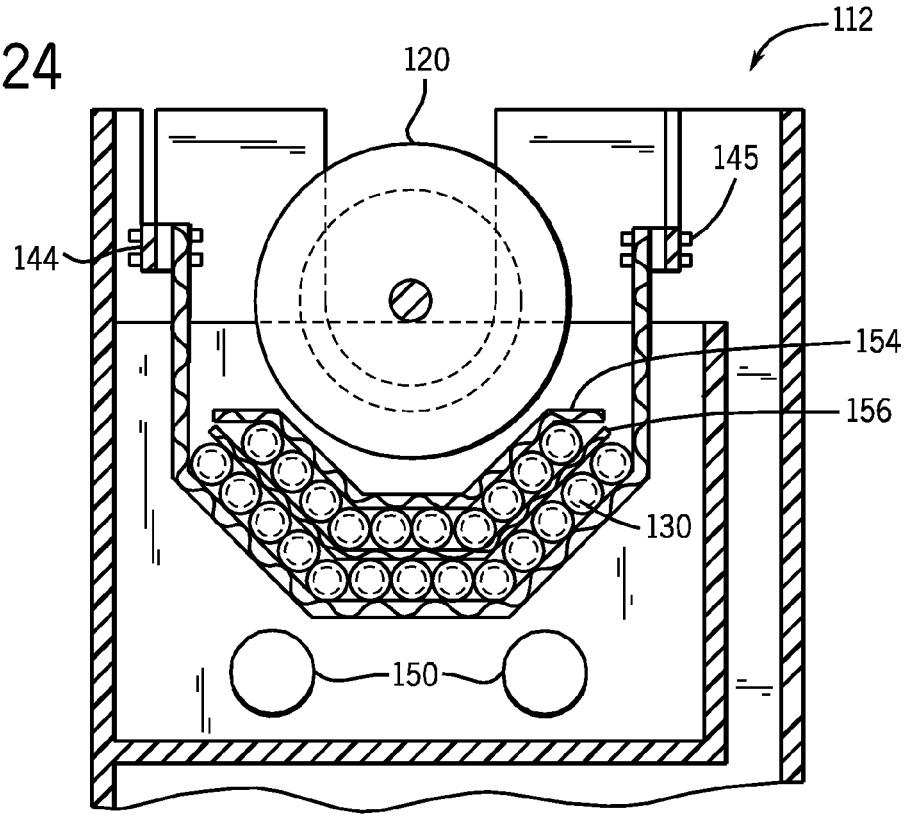
FIG. 24 is a schematic sectional end elevation view of an apparatus for plating a rotogravure cylinder directly out of a plating solution according to an embodiment employing an additional alternate embodiment of a non-dissolvable anode.
Figure 28:
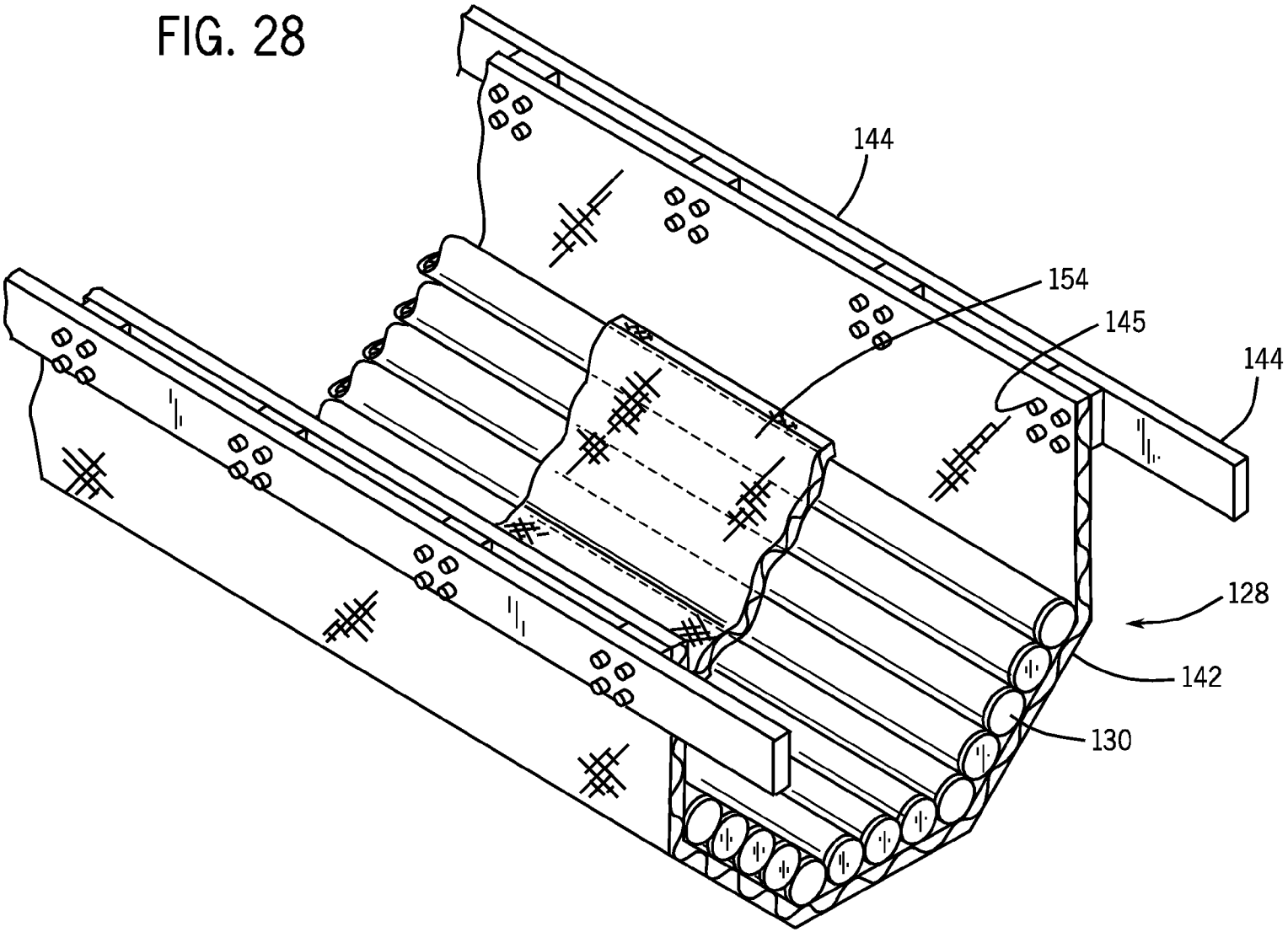
FIG. 28 is a fragmentary perspective view of a non-dissolvable anode according to an alternate embodiment.
Figure 29:
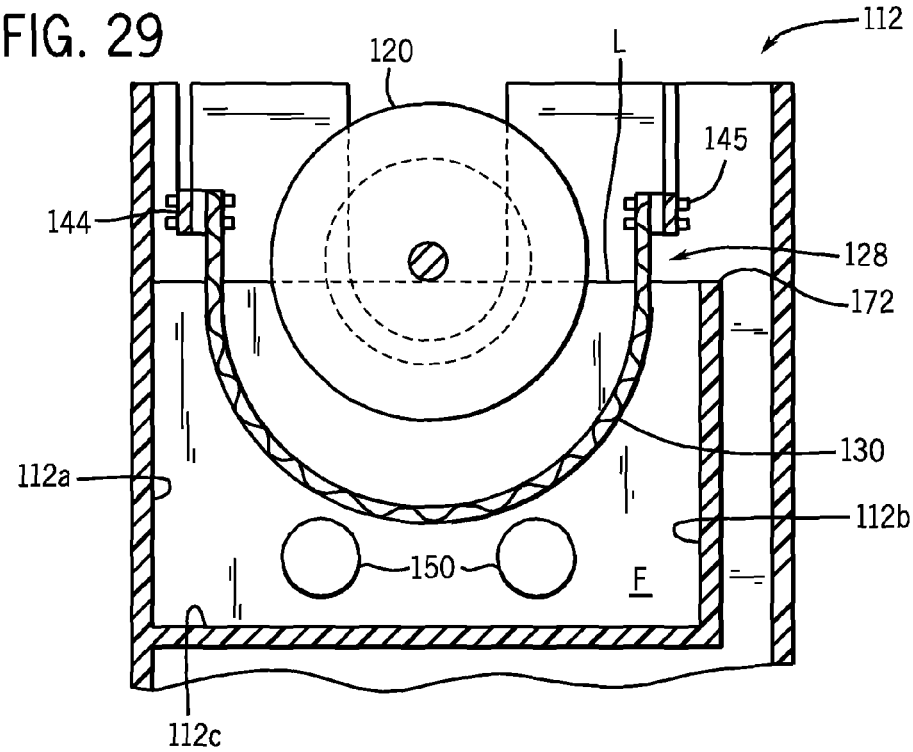
FIG. 29 is a schematic sectional end elevation view of an apparatus for plating a rotogravure cylinder according to an alternative embodiment.
Figure 30:
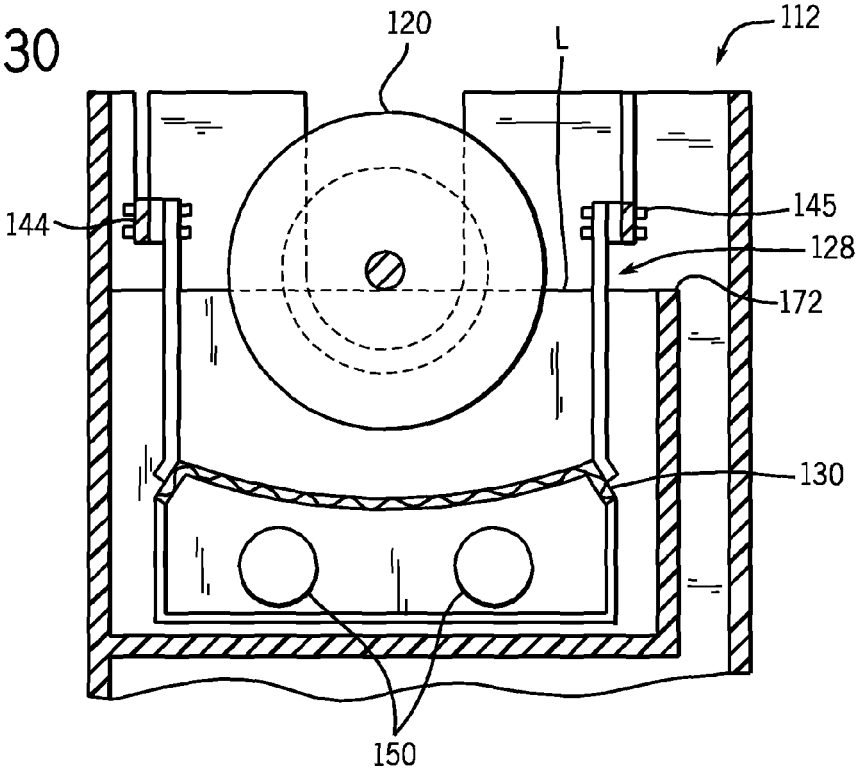
FIG. 30 is a schematic fragmentary end elevation view of an apparatus for plating a rotogravure cylinder according to an alternative embodiment.
Figure 31:
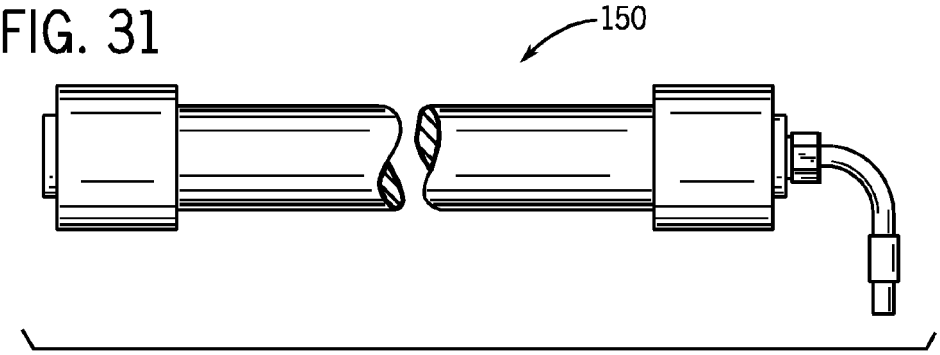
FIG. 31 is a schematic view of an ultrasonic transducer element.

An alternate embodiment of anode system 128, shown in FIGS. 23 and 24, includes at least one non-dissolvable anode 130 and at least one support member 142 that serves as the structural support (i.e. a hanger) for non-dissolvable anode 130. According to a preferred embodiment, support member 142 acts, at least partially, as non-dissolvable anode 130. According to an exemplary embodiment, a plurality of non-dissolvable anodes 130, which may be placed in a variety of configurations, are used. Support member 142 is mechanically fastened and electrically coupled to current carrying rails 144 at junctions employing fasteners 145, shown as bolts. According to an alternative embodiment, shown in FIG. 19, only a portion of support members 142*a* are electrically coupled to current carrying rails 144. A second portion of support rails 142*b* may be made from a nonconductive material (e.g., plastic) and implemented chiefly as a support mechanism for anode 130. Portions of the support members 142 may include a surface material (conductive or nonconductive) to protect, or further protect the portions from the plating solution.

According to an exemplary embodiment, titanium tubes, which may include a protective surface material, are shrunk onto a lead or copper core material. As shown in FIG. 25, non-dissolvable anode 130 may take numerous forms, shapes, or proportions, including having a generally round cross-section (depicted in FIG. 25*a*), a square cross-section (depicted in FIG. 25*b*), a generally rectangular cross-section (depicted in FIG. 25*c*), or of a wide variety of shapes, sizes, proportions, or combinations thereof. According to a preferred embodiment, the ends of core 134 are also protected by a protective surface material. According to one embodiment, shown in FIGS. 25*a-c*, surface material 136 includes caps 140 attached to side portions 139 of protective surface material 136. Depending on the type or nature of the protective surface material used, other methods of protecting the ends of core 134 may be implemented.

According to an alternate embodiment, shown in FIGS. 25*a-b*, a hollow tube 146 manufactured from a conductive material that is resilient to the corrosive effects of the plating solution (e.g., graphite, titanium, etc.), or including a conductive protective surface material substantially resilient to the effects of the plating solution, is filled with a plurality of conductive elements or pieces 148. An exemplary embodiment utilizes metallic elements (e.g., lead or copper alloy balls or nuggets) to fill tube 146. Caps 140, attached to tube 146, seal the ends 147 of the tube and contain and protect the conductive elements 148. Depending on the material used to manufacture tubes 146, other methods of sealing the ends of tubes 146 may be implemented. Tubes 146 may take numerous forms or proportions, including a generally round cross-section as depicted in FIG. 26*a*, a generally rectangular cross-section as seen in FIG. 26*b*, or of a wide variety of shapes, proportions, or combinations thereof. According to an exemplary embodiment, the anode system includes a porous covering (e.g., a polypropylene mesh) covering at least portions of the anode system. The porous covering helps to prevent any particles separated from the anode system from freely entering the plating solution. An exemplary embodiment utilizes the porous covering to further protect the anode system as well as filter the plating solution.

As shown in FIG. 24, apparatus 110 may employ multiple layers of non-dissolvable anodes 130, which may be placed in a variety of configurations, thereby further increasing the size (or surface area) of the anode. One row of non-dissolvable anodes 130 may be directly "stacked" on another, or, as shown in FIG. 24, be separated by partition 156. According to some embodiments, partition 156 is made of electrically conductive mesh or expanded metal material (e.g., having apertures). Partition 156 may be attached to non-dissolvable anodes 130 or support members 142 by welding or other comparable method or fixture. As depicted in FIGS. 23 and 24, according to an exemplary embodiment, anode system 128 includes a covering 154. Anode system 128 may also include non-dissolvable anodes 130. Covering 154 may be configured to cover non-dissolvable anodes 134. According to some embodiments, covering 154 is made of electrically conductive mesh or expanded metal material (e.g., having apertures). Covering 154 is attached to conductors 132 or support structure 144 by welding or other comparable fixture. According to any particular preferred embodiment, the apertures within the mesh (or expanded metal material) create flow paths for circulation of the plating solution, increase the surface area for the anode, and further promote uniform transmission of the ultrasonic energy. Covering 154 may comprise platinum or titanium.

According to any of the preferred embodiments, the ability to perform plating of a rotogravure cylinder 120 directly out of solution using a non-dissolvable anode 130 eliminates the need to place unprotected solid metallic material (i.e., copper nuggets or any other unprotected anode susceptible to corrosion or chemical attack) in close proximity to cylinder 120. This configuration substantially reduces or eliminates uneven or undesirable deposits on a cylinder as a result of the sludge caused by dissolution of an unprotected anode or other unprotected surfaces. The plating process according to any preferred embodiments is thereby intended to produce a more uniform, consistent grain structure of the plated material as well as to speed the plating by allowing more energy (i.e. a higher current density on the plated surface) to be applied during plating without adverse effects.

The plating process according to any preferred embodiment is intended to speed up the plating process yet produce a more uniform, consistent grain structure of the plated material on the cylinder and reduce the amount of polishing and other subsequent steps to prepare the cylinder for use.

According to other preferred embodiments, shown schematically in FIGS. 1, 9, 22, and 39 ultrasonic energy may be used in conjunction with the plating process using an anode system 128 having at least one non-dissolvable anode 130, to provide a more uniform and consistent grain structure on the plated surface of cylinder 120.

Figure 10:
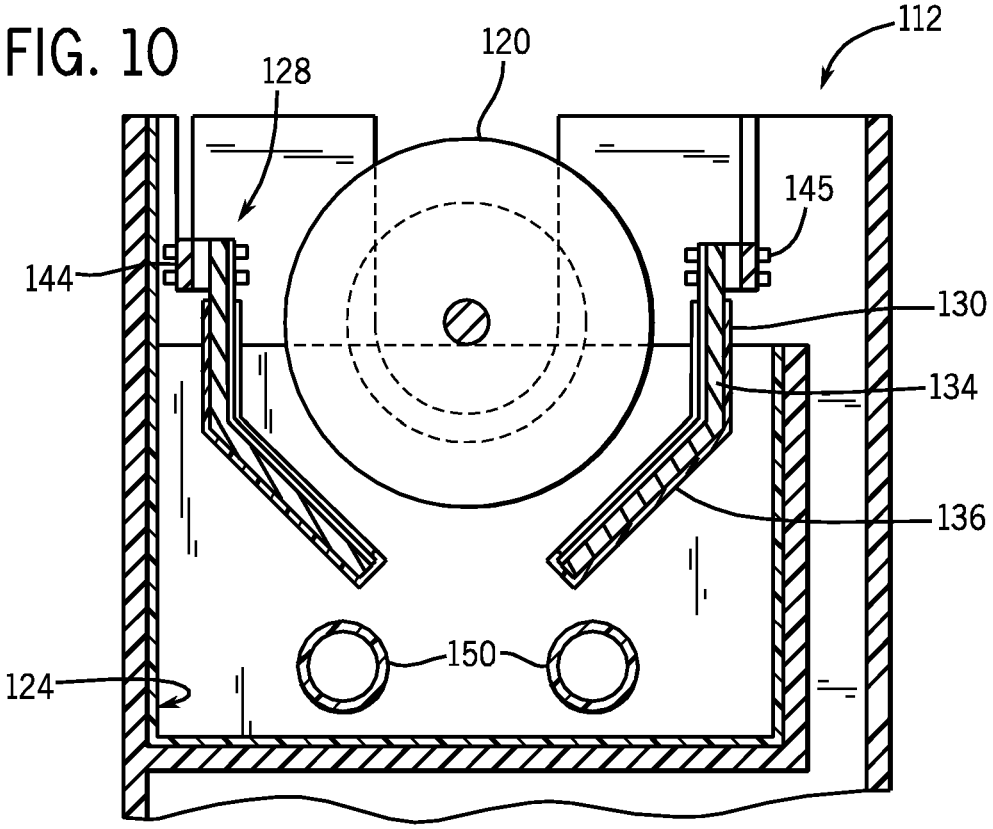
FIG. 10 is a schematic sectional end elevation view of an apparatus for plating a rotogravure cylinder according to an embodiment employing a non-dissolvable anode.

As shown schematically in FIGS. 1, 9, 22, and 39 a transducer element 150, or plurality of transducer elements can be readily installed within plating tank 112 to introduce ultrasonic wave energy to facilitate the plating process. Multiple ultrasonic transducer elements can be installed in the plating tank (and may be disposed beneath non-dissolvable anode 132 as shown in FIGS. 6, 10 and 14) to ensure coverage (i.e., transmission of ultrasonic wave energy to) along the entire length of the surface of cylinder 120. The transducer elements 150 (shown as two elements) are electrically coupled to a control system and are provided to introduce ultrasonic wave energy into plating tank 112. Transducer elements 150 can be of any type disclosed or of any other suitable type that may be known to those who review this disclosure, and can be mounted or inserted according to any suitable method.

Alternative embodiments may employ various arrangements of transducer elements to optimize plating (and deplating) performance in view of design and environmental factors (such as the ultrasonic energy intensity, flow conditions, sizes, shapes and attenuation of the tank, anode system, cylinder, etc.). According to a preferred embodiment, transducer elements 150 include a protective surface material. Transducer elements 150 are configured and positioned to assist with the plating process (e.g. to facilitate consistency of ion migration through the electrolytic fluid), and to prevent any fouling buildup on the various elements of apparatus 110.

Referring to FIGS. 1, 9, 22, and 39 shown disposed lengthwise along the bottom surface of plating tank 112 (e.g., bonded or securely mounted thereto) are ultrasonic transducer elements 150. Transducer elements 150 can be of any variety known in the art. In the exemplary embodiment shown in FIG. 1, a portion of the transducer elements are configured and positioned in relation to anode system 128 as to assist with the plating process directly (e.g., to facilitate consistency of ion migration to cylinder 120), and to provide a cleaning function and maintain anode system 128, cylinder 120 and other elements of and about plating tank 112 free of sludge and other fouling buildup.

Figure 32:
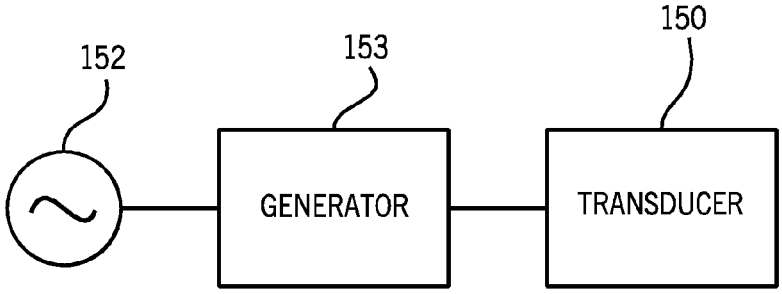
FIG. 32 is a schematic diagram of the ultrasonic transducer system.

Referring to FIG. 32, according to a preferred embodiment, the ultrasonic system includes an ultrasonic power generator 153 for transforming a commercial supply of electric power (e.g., typically provided at low frequency such as 60 Hz) to an ultrasonic frequency range (approximately 120 kHz), a transducer element 150 for converting the high frequency electrical energy provided by generator 153 into ultrasonic energy (i.e. acoustical energy) to be transmitted into and through the electrolytic fluid, and a low voltage direct current (DC) power supply 152 for powering generator 153 and transducer elements 150. Alternative embodiments, however, may operate at higher frequencies (e.g. above 120 kHz), where cavitation action tends to result, or may operate over a varying range of frequencies. According to a particularly preferred embodiment, the transducer elements are designed to provide for operation in a frequency range of 15 to 30 kHz (cycles).

As has been described, the plating process is enhanced by the introduction of ultrasonic wave energy into the plating tank. An ultrasonic generator converts a supply of alternating current (AC) power (e.g. at 50 to 60 Hz) into a frequency corresponding to the frequency of the ultrasonic transducer system (oscillator); the usual frequency is between 15 or 120 kHz and 40 kHz. The energy to the transducer (from the generator or oscillator) is supplied by means of a protected connection (e.g. a cable) transmitting energy at the appropriate frequency. The transducer element converts the electrical energy into ultrasonic energy, which is introduced into the plating solution as vibration (at ultrasonic frequency). The vibration causes (within the plating solution) an effect called cavitation, producing bubbles in the solution which collapse upon contact with surfaces (such as the plated cylinder). The greater amount of ultrasonic wave energy introduced into the plating tank, the greater this effect.

Figure 33:
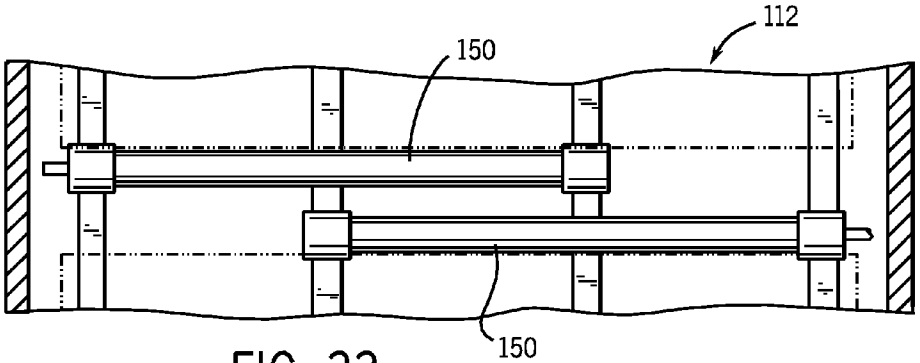
FIG. 33 is a plan view of an exemplary arrangement of ultrasonic transducer elements within a plating tank according to an alternative embodiment.
Figure 34:
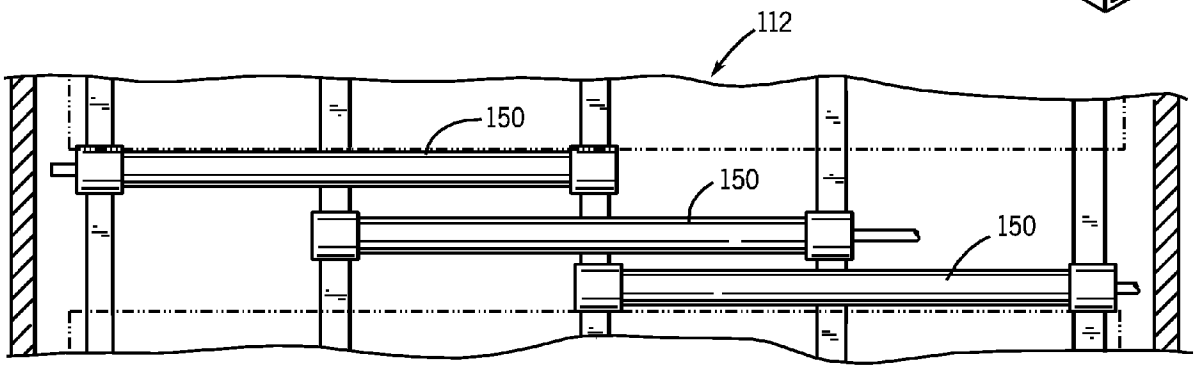
FIG. 34 is a schematic sectional perspective view of a plating tank showing alternative arrangements of ultrasonic transducer elements.

According to an exemplary embodiment, two, three, or more ultrasonic transducer elements can be installed in a staggered or offset pattern to ensure coverage of (i.e. transmission of ultrasonic wave energy to) and along the entire length of the surface of the cylinder, as shown in FIGS. 33 and 34.

According to any preferred embodiment, the transducer element is provided with some type of protective outer cover, preferably electrically isolated and resistant to the chemical and other effects of the plating solution. For example, the transducer element may have a multi-layer protective cover with an outer layer and an inner covering sleeve (or like material) that forms a tight fit to the transducer element, made of "heat shrink" tubing, of a material (such as plastic or a like "inert" material) that is resistant to the effects of the plating solution. According to other alternative embodiments, the protective cover may include a layer of protective coating material (e.g., a coating) that can be applied directly to the transducer element by spraying, brushing, dipping, etc. (in place of or along with other "layers" or elements of protective cover). According to any alternative embodiment, the protective cover for the transducer element may be provided in a wide variety of forms and can include one or more layers of material or one or more elements (e.g. coating, wrap, sleeve, tube, fluid filled tube, etc.) that provides the protective function.

According to any preferred embodiment, the transducer elements efficiently convert electrical input energy from the generator into a mechanical (acoustical) output energy at the same (ultrasonic) frequency. The power generator is located apart from the plating tank, and may be shielded from the effects of the plating solution. The transducer elements can be generally of a ceramic or metallic material (or any other suitable material), and may have a construction designed to withstand the effects of the plating solution in which they are immersed, and positioned to provide uniform energy (and thus uniform cavitation) throughout the anode system and rotogravure cylinder. (Exemplary transducer elements are described in the articles cited herein previously and incorporated by reference herein.) Alternative embodiments may employ various arrangements of transducer elements to optimize plating (and deplating) performance in view of design and environmental factors (such as the ultrasonic energy intensity, flow conditions, sizes, shapes and attenuation of the tank, anode system, cylinder, etc.).

The use of ultrasonic energy increases plating rates by facilitating rapid replenishing of metal ions in the cathode film during electroplating. The ultrasonic energy is also very beneficial in removing absorbed gases (such as hydrogen) and soil from the electrolytic fluid and the surfaces of other elements during the electroplating process. According to any particularly preferred embodiment, the transducer elements are arranged to provide ultrasonic energy at an intensity (e.g. frequency and amplitude) that provides for uniform and consistent agitation throughout the plating solution suitable for the particular arrangement of plating tank 112, cylinder 120 and anode system 128. As contrasted to mechanical agitation, which may tend to leave "dead spots" in the plating tank with where there is little if any agitation, ultrasonic agitation may readily be transmitted in a uniform manner (according to the orientation of the array of transducer elements).

Ultrasonic agitation according to a exemplary embodiment will further provide the advantage of preventing gas streaking and burning at high current density areas on the cylinder without causing uneven or rough deposits. As a result, the use of ultrasonic energy to introduce agitation into the plating tank produces a more uniform appearance and permits higher current density to be used without "burning" the highest current density areas of the cylinder like the edge of the cylinder. (Usually the critical area of burning or higher plating buildup is the edge of the cylinder.) (Ultrasonic energy also can be used in chrome tanks to increase the hardness of the chrome, to increase the grain structure of the chrome and to eliminate the microcracks in chrome.)

A further advantage of a preferred embodiment of the plating apparatus using ultrasonic energy is that it expands the range of parameters for the plating process such as current density, temperature, solution composition and general cleanliness. The surface of a plated cylinder that used ultrasonic energy according to a preferred embodiment will tend to have a much finer grain size and more uniform surface than a cylinder that used a conventional plating process. The plated surface hardness would typically increase (without any additive) by approximately 40 to 60 Vickers, evidencing a much finer grain structure. The use of ultrasonic energy in the plating process therefore allows a minimum or no polishing of the cylinder.

According to a particularly preferred embodiment, the apparatus may employ a modular ultrasonic generator (e.g. Model No. MW GTI/GPI from Martin Walter) with at least one cylindrical "push-pull" transducer element (e.g. suitably positioned within the tank for efficient operation in the particular application); according to alternative embodiments, the transducer elements can be any of a variety of other types, installed on other tank surfaces and/or other orientations; the generator may be of any suitable type.

Figure 36:
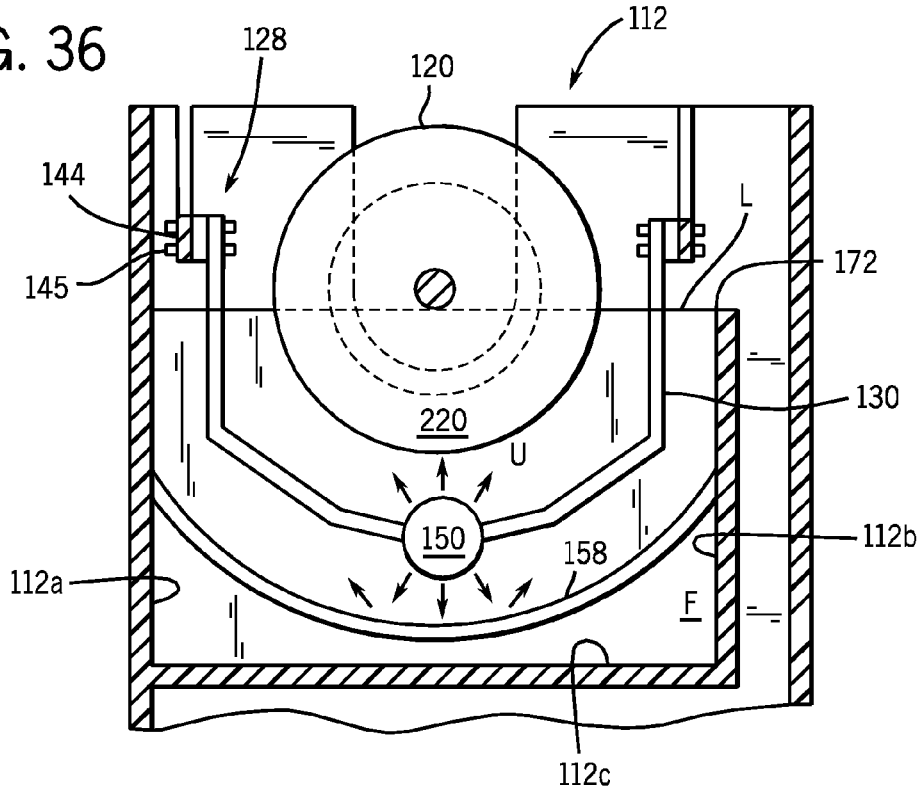
FIG. 36 is a sectional and partial elevation view of a plating tank according to an additional alternative embodiment.
Figure 35:
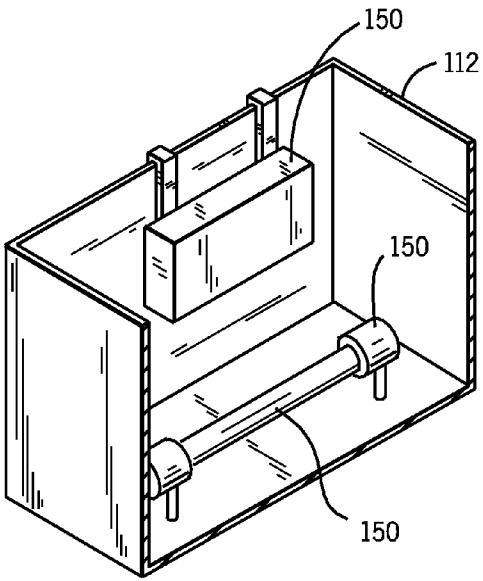
FIG. 35 is a sectional end and elevation view of the plating tank showing alternative arrangements of ultrasonic transducer elements.

According to an exemplary embodiment, underneath transducer element 150 is placed a reflector 158 having a highly polished reflective surface shown mounted to side walls of plating tank 112. Reflector 158 is shown in the preferred embodiment as being of an integral unit having an accurate shape, and extends substantially along the entire length of cylinder 120 (as does transducer element 150). Alternatively, the reflector can be provided with any other suitable shape (such as parabolic or flat or multi-faceted) or in segments. Transducer element 150 when energized will transmit wave energy (shown partially by reference letter U in FIG. 36) in a substantially radial pattern through the plating solution, including toward cylinder 120 and against reflector 158 which will reflect the wave energy back to cylinder 120 and related structures (such as the anode system 128). The direct and reflected ultrasonic wave energy is intended to keep the surfaces of the cylinder and related structures free of fouling buildup and to facilitate the plating process.

According to the preferred embodiments, plating can be conducted in accordance with the same basic range of values of process parameters as for plating by convention methods (i.e., without using a non-dissolvable anode or ultrasonic energy). The plating process according to the preferred embodiments is intended to produce a more uniform, consistent grain structure of the plated material as well as to speed the plating by allowing more energy (i.e., a higher current density on the plated surface) to be applied during plating without adverse effects. According to exemplary embodiments, copper can be plated with a current density in a range of approximately 1 to 3 amperes per square inch (as compared with 0.8 to 1.2 amperes per square inch as an example for a typical conventional process); chrome can be plated with a current density in a range of approximately 5 to 12 amperes per square inch (as compared with 5 to 7 amperes per square inch as an example for a typical conventional process). As a result, in an exemplary embodiment, plating may be accomplished as much as 40 to 50 percent faster, or an increased thickness of plated material can be achieved in a given time period. For example, all other parameters being maintained constant, if a conventional system plates a Ballard shell of approximately 0.0027 inches onto the cylinder in approximately 30 minutes without using ultrasonic energy, by using ultrasonic energy according to a preferred embodiment, after 30 minutes a Ballard shell of approximately 0.004 inches in thickness would be plated onto the cylinder.

According to an exemplary embodiment for plating with copper (e.g., from copper nuggets, cuprous oxide, cupric oxide, copper sulfate), the plating solution is maintained at a temperature of approximately 25 to 35° C. (preferably 30 to 32° C.) with a concentration of 180 to 295 grams/liter of copper sulfate (preferably 220 to 290 grams/liter) and 40 to 80 grams/liter of sulfuric acid (preferably 50 to 60 grams/liter); ultrasonic energy (i.e. power) can be applied in a range of 1.5 to 6 kVA. According to a particularly preferred embodiment for plating with chrome (e.g., directly out of solution), the plating solution is maintained at a temperature of approximately 55 to 65° C. with an initial concentration of 120 to 250 grams/liter of chromic acid and 1.2 to 2.5 grams/liter of sulfuric acid; ultrasonic energy (i.e., power) can be applied in a range of 1.5 to 6.0 kVA. As is apparent to those of skill in the art who review this disclosure, the values of process parameters may be adjusted as necessary to provide a plated surface having desired characteristics. According to alternative embodiments, these ranges may be expanded further, using the advantages of ultrasonic energy.

In comparison to conventional methods (e.g., without using ultrasonic energy), the rotogravure cylinder plated according to many embodiments will provide a surface better suited for subsequent engraving and printing. The plated surface of the cylinder will be characterized by a hardness similar to that obtained by conventional methods, but the grain structure (i.e., size) will be more consistent across and along the surface (i.e., both around the circumference and along the axial length of the cylinder), by example (for copper plating) varying approximately 1 to 2 percent (with ultrasonic) in comparison to approximately 4 to 10 percent (without ultrasonic). (According to other exemplary embodiments, the plated surface hardness may increase 120 to 30 Vickers.)

Figure 37:
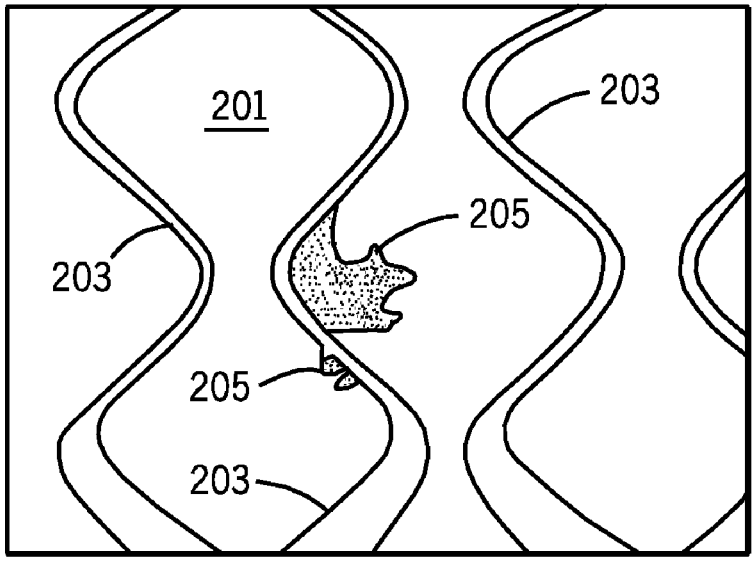
FIG. 37 is a schematic view of the grain structure of a rotogravure cylinder plated according to a conventional method.
Figure 38:
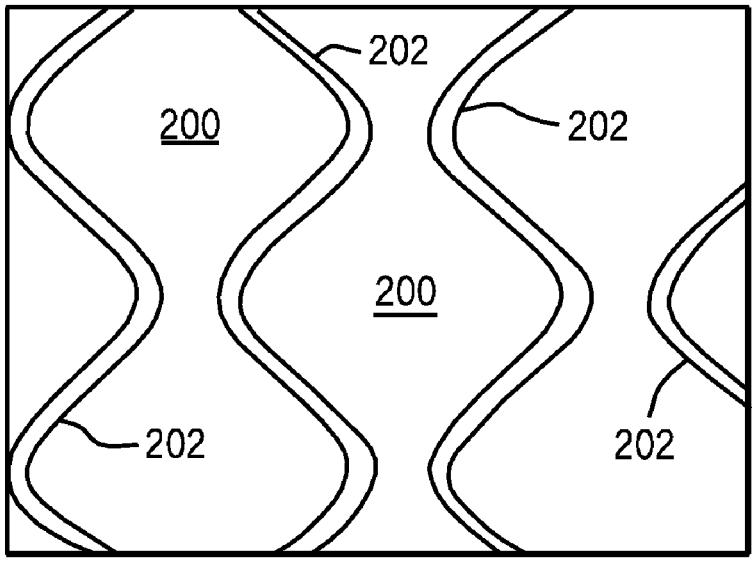
FIG. 38 is a schematic view of the grain structure of the rotogravure cylinder plated according to a preferred embodiment.
Figure 41:
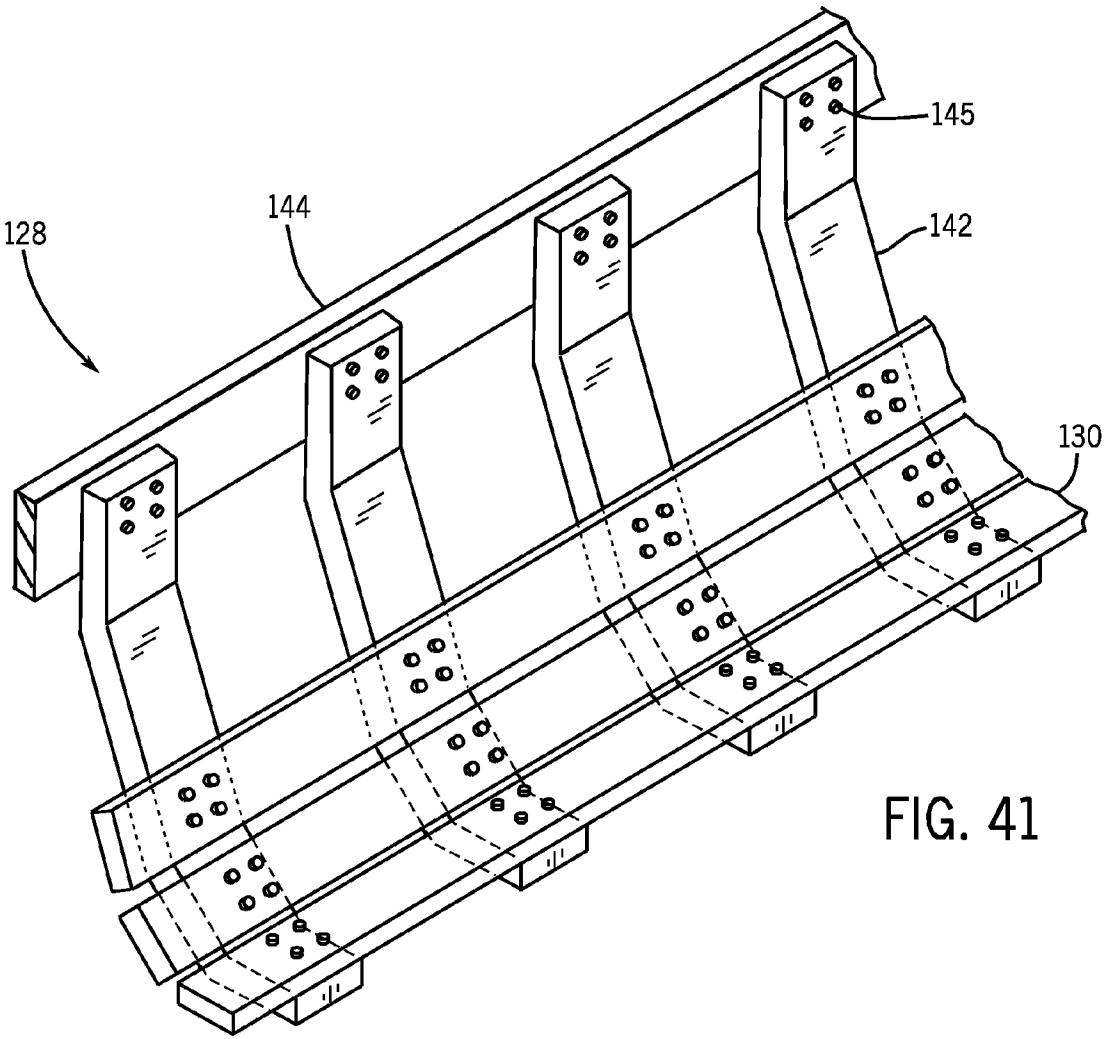
FIG. 41 is a fragmentary perspective view of the non-dissolvable anode of FIG. 39.

The surface plated according to one embodiment of the present invention will exhibit an engraved cell structure 200 as shown in FIG. 38 (schematic diagram) with cell walls 202 of a generally consistent width and shape and relatively and substantially free of "burrs" or other undesirable deposits of material following the engraving process. By conventional methods, shown in FIG. 37, the structure of cell 201 is somewhat less consistent in form and dimension, as well as having material deposits 205 on or near walls 203 that may cause irregularities or defects during printing, see "The Impact of Electromechanical Engraving Specifications on Streaking and Hazing," Gravure (Winter 1994), which is incorporated by reference herein. Cells 200 of a consistent structure, as shown in FIG. 38, with less distortion and less damage during engraving, provide a surface on the cylinder which can more efficiently be inked and cleaned and which is therefore more capable of printing a high quality image in the final product. When, such uniformity and consistency can be achieved across the length of the cylinder (not just in isolated portions of the surface), the overall printing quality is enhanced.

According to any exemplary embodiment, as shown schematically in FIGS. 1, and 39 plating apparatus 110 includes holding tank 114 which may include at least one supply pipe 160, and at least one spray bar 162 that supplies a flow of plating solution to plating tank 112. The spray bar 162 can be adjustable to accommodate objects (e.g., rotogravure cylinders) of varying sizes. In a particularly preferred embodiment, an adjustable spray bar 162 is coupled to an adjustable anode system 128. Supply pipes 160 are coupled to a circulation pump 164 (configured and operated according to a known arrangement) that may or may not have a filter system 166. According to an exemplary embodiment, filter system 166 (including a system of multiple filters) is used to further reduce or minimize the amount of sludge in the plating solution or in plating tank 112 that may otherwise come into contact or near contact with cylinder 120. As shown schematically in FIG. 1, circulation pump 164 draw plating solution F from holding tank 114 into inlets 161 in each of supply pipes 160 and force it under pressure through filter system 166 and into spray bars 162 where it is reintroduced through apertures into plating tank 112 for the electroplating process. In a preferred embodiment, each of spray bars 162 extends along the bottom of plating tank 112, rising horizontally from holding tank 114 and turning to run horizontally along and beneath anode system 128. According to alternative embodiments, apparatus 110 may include one pump and filter coupled to either a single spray bar or a spray bar manifold system, or any other combination of elements that provide for the suitable supply of plating solution F into plating tank 112. According to an exemplary embodiment, filter system may include a porous material (e.g., polypropylene mesh) for filtering the plating solution. According to an exemplary embodiment, the holding tank and/or the plating tank is lined with a porous material which filters the plating solution or its precursors (i.e., any material used to create or refresh to the plating solution) before the plating solution is allowed to contact the cylinder.

Plating solution may build up heat and increase in temperature over time during the plating (or deplating) process and therefore plating tank 112 and/or holding tank 114 may be equipped with a fluid cooling system 116 (e.g., a suitable heat exchanger for such fluid of a type known in the art). Likewise, electrolytic fluid may need to be heated from an ambient temperature to a higher temperature at the outset of the plating process and therefore plating tank 112 and/or holding tank 114 may be equipped with a fluid heating system 118 (e.g., a suitable heat exchanger for such fluid of a type known in the art). The temperature regulating system for the plating solution can be coupled to an automatic control system that operates from information obtained by temperature sensors in or near one or both tanks, and to control other parameters that may be monitored during the process, according to known arrangements. Before the electroplating process begins, the ultrasonic system can be energized to provide for agitation of the electrolytic fluid and for cleaning the system to provide for better contact and plating performance.

According to any preferred embodiment, holding tank 114, supply pipe 160, spray bar 162, filter system 166, circulation pump 164, mixing system 254, heating system 118, cooling system 116, transducer element 150, or other pieces that may be exposed to the plating solution (electrolytic fluid F) may be formed from a material substantially resilient to the plating solution, or include a surface material substantially resilient to the plating solution along their (individually or collectively) entire surface area, along substantial portions of their (individually or collectively) surface area, along part of their (individually or collectively) surface area, or strategically placed along those surfaces that may be exposed to corrosion or chemical attack.

In an exemplary embodiment, shown schematically in FIGS. 9, 22, and 39 a mixing or dosing tank 180 is coupled to holding tank 114. Alternatively, dosing tank 180 may be coupled to plating tank 112. Dosing tank 180, in conjunction with one or more of a sensor array 170, dosing pump 182, timer (not shown), volumetric feeder (e.g., commercially available, for example from TecWeigh of St. Paul, Minn.) (not shown) or other like device, introduces a material that will refresh the plating solution (i.e., in the case of copper plating; copper sulfate, copper oxide, cuprous oxide, etc. which may have been provided in ionic form or which may have been converted—e.g. oxidized—to that ionic form) directly or indirectly into plating tank 112. As shown schematically in FIG. 9, dosing tank 180 introduces (e.g., gravity feed, gear system, value system, etc.) a material that will refresh the plating solution into holding tank 114, which then transfers the refreshed solution to plating tank 112. Dosing tank 180 may include a diffuser to allow better mixing of the material used to refresh the plating solution into the plating solution and/or to ensure more complete ionization of the material.

According to any exemplary embodiment, dosing tank, holding tank, or plating tank can be lined with or otherwise includes a porous material (e.g., polypropylene mesh) for filtering the plating solution or its precursors (e.g., cupric oxide, cuprous oxide, copper sulfate) before the plating solution comes in contact with cylinder 120.

According to an exemplary embodiment as shown schematically in FIG. 39, holding tank 114 or plating tank 112 can include a mixing system 252 to facilitate the dissolution and/or circulation of the copper plating material (e.g., cuprous oxide, cupric oxide, copper sulfate, etc.) into the plating solution. According t one embodiment, mixing system 252 can include a motor driven mixer (e.g., propeller, mixing blade or other mechanical agitation device).

According to any exemplary embodiment, a separate tank 252 can be used to introduce the hardening agent into the plating solution. The hardening agent can be introduced directly or indirectly into either the plating tank 112 or holding tank 114. Tank 252, in conjunction with a sensor array, dosing pump, timer, volumetric feeder or other like device, introduces the hardening agent directly or indirectly into the plating solution.

According to any exemplary embodiment, dosing tank 180, tank 252, sensor array, dosing pump, volumetric feeder, mixing system 254 or other constituent parts that may be exposed to the plating solution or its precursors may be formed from a material substantially resilient to the plating solution or its precursors along their (individually or collectively) surface area or along part of their (individually or collectively) surface area, or strategically placed along those surfaces that may be exposed to corrosion or chemical attack.

As shown in FIG. 43, the proximity of cylinder 120 to anode system 128 may be determined by a proximity sensor 129 (shown schematically). As shown in FIG. 5, lifter 174 may be controlled based on a signal output by proximity sensor 129.

Other solution concentration parameters (e.g. hardener concentration, brightener concentration, etc.) may be monitored by one or more control systems using one or more additional sensors.

In exemplary embodiments, an anode may comprise a mesh or grid formed from a material substantially resilient to the plating solution.

According to exemplary embodiments, non-dissolvable anodes may be in direct contact with one another. In alternate embodiments the non-dissolvable anodes are spaced apart. The anodes may contain spaces between portions of the conducting materials that allow the plating solution to flow through the spaces between the anodes. These embodiments may comprise solid anodes spaced apart and may include meshes or grids.

Although only a few exemplary embodiments of this invention have been described in detail above, those skilled in the art will readily appreciate that many modifications are possible in the exemplary embodiments (such as variations in sizes, structures, shapes and proportions of the various elements, values of the process parameters, mounting arrangements, or use of materials) without materially departing from the novel teachings and advantages of this invention. Other sequences of method steps may be employed. Accordingly, all such modifications are intended to be included within the scope of the invention as defined in the following claims. In the claims, each means-plus-function clause is intended to cover the structures described herein as performing the recited function and not only structural equivalents but also equivalent structures. Other substitutions, modifications, changes and omissions may be made in the design, operating conditions and arrangement of the preferred embodiments without departing from the spirit of the invention as expressed in the appended claims. It should be understood that the plating apparatus according to alternate embodiments may be configured to plate alternate types of objects.

What is claimed is:

1. A method for electroplating a rotogravure cylinder with copper out of a plating solution, the method comprising:

providing an apparatus comprising a first tank adapted to receive the rotogravure cylinder and to contain the plating solution, a second tank coupled to the first tank such that plating solution may be transferred from the second tank to the first tank, and a non-dissolvable anode configured to be at least partially disposed within the plating solution;

attaching metallic shields to the ends of the rotogravure cylinder;

providing the plating solution comprising copper ions in the first tank;

connecting the rotogravure cylinder to a current source;

connecting the non-dissolvable anode to the current source;

providing the non-dissolvable anode with a current of at least 1 ampere per square inch;

providing the rotogravure cylinder in the first tank such that the rotogravure cylinder is at least partially disposed into the plating solution;

plating copper on the rotogravure cylinder using the non-dissolvable anode in a rotogravure plating process;

adding copper ions to the plating solution of the first tank during the rotogravure plating process using at least a source of copper ions not connected to an anode of the apparatus; and providing a hardener that increases the hardness of copper plated on the rotogravure cylinder.

2. The method of claim 1, wherein providing hardener comprises providing a hardener that is substantially chloride-free.

3. The method of claim 1, wherein dissolving the material capable of refreshing the plating solution comprises dissolving copper oxide in plating solution.

4. The method of claim 1, further comprising spraying plating solution from the second tank in the first tank using a spray bar.

5. The method of claim 1, wherein providing the rotogravure cylinder comprises providing a rotogravure cylinder having a circumference of about 400 mm to about 1800 mm.

6. The method of claim 5, wherein plating copper on the rotogravure cylinder comprises plating the rotogravure cylinder to a copper thickness of at least about 0.003 inches.

7. The method of claim 5, wherein plating copper on the rotogravure cylinder comprises plating the rotogravure cylinder to a copper thickness of at least about 0.01 inches.

8. The method of claim 1, wherein providing the rotogravure cylinder and providing the plating solution comprise providing the rotogravure cylinder and the plating solution such that the rotogravure cylinder is submerged in the plating solution at least about 267 mm.

9. The method of claim 1, wherein adding copper ions comprising providing a material capable of refreshing the plating solution in a third tank, and mixing the material capable of refreshing the plating solution with a solution in the third tank.

10. The method of claim 1, wherein providing a hardener that increases the hardness of copper plated on the rotogravure cylinder comprises pumping the hardener into the first tank.

11. The method of claim 1, wherein pumping the hardener into the first tank comprises pumping hardener mixed with plating solution into the first tank.

12. The method of claim 1, further comprising contacting the rotogravure cylinder with an acidic solution.

13. The method of claim 12, wherein said acidic solution comprises sulfuric acid.

14. A method for electroplating a rotogravure cylinder with copper out of a copper plating solution using a current source, the method comprising:

providing the rotogravure cylinder in a tank such that the rotogravure cylinder is at least partially disposed in the copper plating solution;

coupling the rotogravure cylinder to the current source such that the rotogravure cylinder operates as a cathode;

coupling a conductive material that is substantially resilient to the plating solution to the current source such that the conductive material may operate as an anode;

applying current such that the rotogravure cylinder is copper plated by copper ions from the copper plating solution in the first tank;

providing copper plating solution from a container to the tank as the rotogravure cylinder is plated by material from the plating solution from the tank;

adding copper ions to the plating solution of the tank during the rotogravure plating process using at least a source of copper ions not connected to an anode of the apparatus; and attaching metallic shields to the ends of the rotogravure cylinder.

15. The method of claim 14, wherein the tank is a first tank and wherein providing copper plating solution from a container to the tank as the rotogravure cylinder is plated by material from the plating solution from the tank comprises:

providing copper plating solution from the container to a second tank; and providing copper plating solution from the second tank to the first tank;

wherein the copper plating solution from the container refreshes the copper plating solution in the second tank with copper ions.

16. The method of claim 15, wherein the container comprises a dosing tank.

17. The method of claim 15, further comprising spraying plating solution from the second tank in the first tank using a spray bar.

18. The method of claim 14, further comprising providing a hardener that increases the hardness of copper plated on the rotogravure cylinder.

19. The method of claim 18, wherein providing a hardener that increases the hardness of copper plated on the rotogravure cylinder comprises pumping the hardener into the tank.

20. The method of claim 19, wherein pumping the hardener into the first tank comprises pumping hardener mixed with plating solution into the tank.

21. The method of claim 14, wherein providing the rotogravure cylinder comprises providing a rotogravure cylinder having a having a circumference of about 400 mm to about 1800 mm.

22. The method of claim 21, wherein plating copper on the rotogravure cylinder comprises plating the rotogravure cylinder to a copper thickness of at least about 0.003 inches.

23. The method of claim 21, wherein plating copper on the rotogravure cylinder comprises plating the rotogravure cylinder to a copper thickness of at least about 0.01 inches.

24. The method of claim 14, wherein the container is a first container and wherein adding copper ions comprises providing a material capable of refreshing the plating solution in a second container, and mixing the material capable of refreshing the plating solution with a solution in the second container.

25. The method of claim 14, further comprising contacting the rotogravure cylinder with an acidic solution.

26. The method of claim 25, wherein said acidic solution comprises sulfuric acid.

27. The method of claim 14, further comprising:

controlling an operation of the process using a controller.

28. The process of claim 27, wherein controlling an operation of the process using a controller comprises controlling, using the controller, addition of copper ions to the plating solution of the tank during the rotogravure plating process using at least a source of copper ions not connected to an anode of the apparatus.

29. The method of claim 14, wherein the metallic shield comprises at least one of stainless steel and titanium.

30. The method of claim 14, wherein the metallic shield is coupled to the current source.

* * * * *

UNITED STATES PATENT AND TRADEMARK OFFICE

CERTIFICATE OF CORRECTION

PATENT NO. : 8,298,395 B2
APPLICATION NO. : 12/497477
DATED : October 30, 2012
INVENTOR(S) : Hubert F. Metzger It is certified that error appears in the above-identified patent and that said Letters Patent is hereby corrected as shown below:

ON THE FRONT PAGE

The Related U.S. Application Data section should read:

Continuation-in-part of application No. 12/386,170, filed on Apr. 13, 2009, now Pat. No. 7,914,658, and is a continuation-in-part of application No. 10/852,597, filed on May 24, 2004, now Pat. No. 7,556,722, which is a continuation-in-part of application No. 09/992,205, filed on Nov. 6, 2001, now Patent No. 6,929,723, which is a continuation-in-part of application No. 09/528,393, filed on Mar. 20, 2000, now Pat. No. 6,547,936, which is a continuation in-part of application No. 09/345,263, filed on Jun. 30, 1999, now Pat. No. 6,231,728.

Signed and Sealed this
Nineteenth Day of February, 2013

Teresa Stanek Rea

Teresa Stanek Rea
*Acting Director of the United States Patent and Trademark Office*